US011357291B2

(12) United States Patent
Sun et al.

(10) Patent No.: US 11,357,291 B2
(45) Date of Patent: Jun. 14, 2022

(54) SKI BOOT

(71) Applicant: Yingui Sun, Beijing (CN)

(72) Inventors: Yingui Sun, Beijing (CN); Hui Zhou, Beijing (CN)

(73) Assignee: Yingui Sun, Beijing (CN)

( * ) Notice: Subject to any disclaimer, the term of this patent is extended or adjusted under 35 U.S.C. 154(b) by 258 days.

(21) Appl. No.: 16/764,598

(22) PCT Filed: Aug. 27, 2018

(86) PCT No.: PCT/CN2018/102522
§ 371 (c)(1),
(2) Date: May 15, 2020

(87) PCT Pub. No.: WO2019/169836
PCT Pub. Date: Sep. 12, 2019

(65) Prior Publication Data

US 2020/0390195 A1 Dec. 17, 2020

(30) Foreign Application Priority Data

Mar. 7, 2018 (WO) ..... PCT/CN2018/078302

(51) Int. Cl.
*A43C 11/16* (2006.01)
*A43B 5/04* (2006.01)

(52) U.S. Cl.
CPC ..... *A43C 11/165* (2013.01); *A43B 5/04* (2013.01)

(58) Field of Classification Search
CPC ..... A43C 11/165; A43B 23/08; A43B 3/242; A43B 5/00–185
See application file for complete search history.

(56) References Cited

U.S. PATENT DOCUMENTS 4,360,979 A * 11/1982 Spademan ..... A43B 5/0447 36/118.8
4,510,703 A * 4/1985 Eiteljorg ..... A43B 5/0415 36/119.1

(Continued)

FOREIGN PATENT DOCUMENTS

CN 201726919 2/2011
CN 102687929 9/2012

(Continued)

*Primary Examiner* — Shaun R Hurley
*Assistant Examiner* — Bao-Thieu L Nguyen
(74) *Attorney, Agent, or Firm* — Barnes & Thornburg LLP

(57) ABSTRACT

A ski boot, including an outer boot (200) and an inner boot (100); the outer boot (100) comprise a sole (110) and a vamp (120), the sole (110) being integral; the vamp (120) includes a right side portion (122) of the vamp and a left side portion (123) of the vamp, the right side portion (122) of the vamp and the left side portion (123) of the vamp being hinged on the sole (110) such that the same may rotate relative to the sole (110) between an open state and a closed state; the outer boot (100) further includes a locking device (130) and a locking wire (140); the locking wire (140) surrounds the vamp (120) at a plurality of locations on the vamp (120), may be buried in the locking device (130) so as to keep the right side portion (122) of the vamp and the left side portion (123) of the vamp in the closed state, and may be released from the locking device (130) to allow the right side portion of the vamp (122) and the left side portion of the vamp (123) rotate to the open state. Therefore, the ski boot may facilitate a skier putting on and taking off the outer boot (100).

20 Claims, 25 Drawing Sheets

(56) References Cited

U.S. PATENT DOCUMENTS 4,633,599 A * 1/1987 Morell ..... A43C 11/165 242/389
4,669,202 A * 6/1987 Ottieri ..... A43B 1/0018 36/118.5
4,757,621 A * 7/1988 Iwama ..... A43B 5/0447 36/118.1
4,870,761 A * 10/1989 Tracy ..... A43C 1/04 24/712
4,905,384 A * 3/1990 De Marchi ..... A43B 5/0415 36/118.9
4,959,914 A * 10/1990 Hilgarth ..... A43B 3/26 36/117.3
5,005,303 A * 4/1991 Bonaventure ..... A43B 5/048 36/118.8
5,177,885 A * 1/1993 Marmonnier ..... A43B 5/04 36/118.9
5,329,706 A * 7/1994 Pozzobon ..... A43B 5/04 36/117.1
5,412,883 A * 5/1995 Wulf ..... A63C 9/086 36/117.3
5,839,210 A * 11/1998 Bernier ..... A43B 3/0078 36/138
6,416,074 B1 * 7/2002 Maravetz ..... A43C 11/165 36/119.1
7,464,492 B2 * 12/2008 Marechal ..... A43B 5/1625 36/115
8,065,820 B2 * 11/2011 Sartor ..... A43B 5/0474 36/118.2
8,858,482 B2 * 10/2014 Ingimundarson ..... A61F 5/022 128/882
9,295,301 B2 * 3/2016 Rastello ..... A43B 5/0405
9,392,838 B2 * 7/2016 Fischer ..... A43B 5/1666
9,486,039 B2 11/2016 Ha
10,130,138 B2 * 11/2018 Neiley ..... A43C 11/1406
10,136,694 B2 * 11/2018 Fischer ..... A43B 5/1666
10,264,845 B2 * 4/2019 Rastello ..... A43B 5/0476
10,602,804 B2 3/2020 Modena et al.
10,631,589 B2 * 4/2020 Sun ..... A43B 23/0295
2005/0016027 A1 * 1/2005 Trinkaus ..... A43B 3/34 36/117.7
2005/0241189 A1 11/2005 Elkington et al.
2009/0287128 A1 * 11/2009 Ingimundarson ..... A61F 5/0111 602/27
2012/0240428 A1 9/2012 Knoll
2013/0118040 A1 * 5/2013 Rastello ..... A43B 5/0476 36/118.2
2013/0263475 A1 * 10/2013 Merelli ..... A43B 5/0427 36/118.9
2014/0215855 A1 * 8/2014 Frey ..... A43B 5/0405 36/116
2015/0359292 A1 * 12/2015 Chaigne ..... A43B 5/0466 36/118.4
2016/0192729 A1 * 7/2016 Rastello ..... A43B 5/0476 36/117.6
2017/0303644 A1 10/2017 Cavanagh et al.
2018/0361221 A1 * 12/2018 Czaja ..... H04W 4/80
2020/0107606 A1 * 4/2020 Cagliari ..... A43B 23/0205

FOREIGN PATENT DOCUMENTS

CN 203492894 3/2014
CN 104219977 12/2014
CN 104305963 1/2015
CN 204218041 3/2015
CN 104981174 10/2015
CN 105159393 12/2015
CN 204969764 1/2016
CN 206949636 2/2018

* cited by examiner

SKI BOOT

This application is a United States National Stage Application under 35 USC § 371 of PCT Application No. PCT/CN2018/102522, filed Aug. 27, 2018, which claims priority to PCT Application No. PCT/CN2018/078302, filed Mar. 7, 2018, the entirety of which applications is hereby fully incorporated by reference herein.

TECHNICAL FIELD

This disclosure relates to ski boots, in particular, the ski boots that can be put on or taken off by the skier easily and are provided with a life detection system.

BACKGROUND

Ski boots are necessary equipment required during skiing. However, traditional ski boots are cumbersome and make the skier hard to move when wearing the boots. Therefore, there is a need for ski boots that can be put on or taken off by the skier easily.

In the previous application PCT/CN2017/07692 of the applicant, a kind of ski boots were provided that includes a separable shell. The entire prior application is incorporated herein by reference.

It should be noted the above content shall not be acknowledged or considered as prior art due to being included in this section.

SUMMARY

The present disclosure discloses a kind of ski boots which are easy for the skier to put on and take off. The ski boot can timely activate a life monitoring system when the wearer is endangered and timely send the monitored data by means of wireless signals to a designated location, such as a rescue centre, the emergency contact or relatives of the wear, or the like.

According to one aspect of the disclosure, a kind of ski boots is provided, each of which includes a shell and a liner, wherein the shell includes an integral sole and an upper including an upper right portion and an upper left portion, wherein the upper right portion and the upper left portion are articulated onto the sole so as to rotate relative to the sole between an opened state and a closed state, wherein the shell also includes a lock and a locking line, and wherein the locking line winds around the upper at a plurality of positions, and is able to be retracted into the lock so as to maintain the upper right portion and the upper left portion in the closed state and is able to be released from the lock so as to rotate the upper right portion and the upper left portion into the opened state.

Thanks to the disclosure, since the upper right portion and the upper left portion may be opened outward relative to the sole, the liner can be easily taken off and put on so as to facilitate the movement of the skier. Also when needed, the liner may be easily inserted into the shell and the shell is locked so that the ski boots are used as regular ski boots.

The upper also includes a toe cap portion and a heel portion, wherein the heel portion is provided with a plurality of positioning slots or ribs, wherein the upper right portion and the upper left portion are provided with protrusions or slots at the corresponding positions, and wherein the positioning slots or ribs engage with the protrusions or slots respectively when the upper right portion and the upper left portion are in the closed state.

The toe cap portion is provided with a plurality of positioning recesses, and the upper right portion and the upper left portion are provided with a plurality of protrusions at the corresponding positions; and the positioning protrusions engage into the positioning recesses respectively when the upper right portion and the upper left portion are in the closed state.

By utilizing any one or any combination of the positioning ribs provided at the heel portion, the positioning recesses provided at the toe cap portion and the serrated pattern provided at the tongue portion, the lateral and head-to-tail stability of the ski boots can be enhanced.

A biasing device is provided at a position where the tongue portion and the toe cap portion are articulated so as to bias the tongue portion toward the outside. Preferably, the biasing device includes a torsion spring.

Biasing devices are provided at positions where the upper right portion and the upper left portion are respectively articulated with the sole, which respectively bias the upper right portion and the upper left portion toward the opened state. Preferably, the biasing devices include torsion springs.

The lock includes a main shaft secured on the upper right portion or the upper left portion;

a reel rotatably arranged on the main shaft, around which the locking line may wind at a plurality of positions;

a clutch which is rotatably arranged on the main shaft and is able to move along the main shaft between a locking position and an unlocking position, wherein in the locking position the clutch engages the reel so as to drive the reel in rotation in a first direction but prevents the reel from rotating in a second direction which is opposite to the first direction, and in the unlocking position, the clutch disengages from the reel; and a handle which is connected with the clutch so as to drive the clutch to rotate the reel.

The lock includes a locking sleeve which is kept secured relative to the upper right portion or the upper left portion and is concentric around the reel, wherein the locking sleeve and the reel are provided with ratchets respectively, and the clutch is provided with first and second claws respectively engaging with the locking sleeve and the reel at the locking position; and wherein the ratchets of the locking sleeve and the reel are arranged in opposite directions or the first and second claws are arranged in opposite directions.

The lock also includes a claw plate mounted on the clutch and the first claws are provided on the claw plate.

The main shaft includes a second diameter portion, a third diameter portion and a ridge arranged between the second and third diameter portions, wherein the ridge has a diameter larger than the diameters of the second and third diameter portions, and wherein the clutch is located on the second diameter portion of the main shaft in the locking position and the clutch is located on the third diameter portion of the main shaft in the unlocking position.

The clutch is also provided with positioning means so as to determine the position of the clutch on the main shaft.

The positioning means include rolling balls radially arranged in the clutch and bias devices that bias the rolling balls on the main shaft.

The clutch is also provided with locking means so as to lock the clutch in the locking position.

The locking means include inner rolling balls, locking pins and outer rolling balls radially arranged in the clutch as well as the locking ring that is able to sleeve on the outer periphery of the clutch, wherein the locking ring is able to move between the locking position and the unlocking position, and wherein the locking ring prevents the inner rolling balls, locking pins and outer rolling balls from moving outward and passing over the ridge in the locking position and the prevention is cancelled in the unlocking position.

The movement of the locking ring is translated along the main shaft or rotated around the main shaft between the locking position and unlocking position, that is, the locking ring moves from the locking position to the unlocking position by means of movement and vice versa, so as to switch between locking and unlocking.

The lock also includes a biasing spring arranged on the handle which pushes the locking ring to move toward the locking position.

By means of the above structure, the volume of the lock can be reduced at the same time maintaining the advantage of easy operation of the lock, meanwhile an appealing appearance is given to the shell.

The ski boot is also provided with a controller and a sensor, wherein the sensor is configured to sense the signals indicating physiological signs of the skier wearing the ski boots, and wherein the controller is configured to receive the signals sensed by the sensor and determine the physiological status of the wearer based on the signals.

The controller is configured to determine the physiological status of the skier as one of a plurality of categories based on the signals sensed by the sensor.

The physiological signs include one or more of the heart rate, the blood pressure or temperature of the skier.

The controller is also configured to send a rescue signal to a designated destination when it is determined that the physiological status of the skier is in danger.

The designated location includes a plurality of designated destinations.

The rescue signal includes a signal indicating the vital signs of the skier.

The controller is also configured not to send a rescue signal to a designated destination when it is determined that the vital status of the skier is that the skier is able to self restored.

Thanks to the ski boots of the disclosure, when the skier is endangered, for example he falls down, the ski boots can autonomously send a rescue signal to the designated destination, improving the safety of the skier.

BRIEF DESCRIPTION OF THE DRAWINGS

The above and other features, advantages and technical superiority of the disclosure can be understood in light of the detailed description of preferred embodiments of the disclosure with reference to the drawings, in which.

DETAILED DESCRIPTION

Now preferred embodiments of the disclosure will be explained with reference to the drawings. It should be pointed out that the description is illustrative and by no means limiting. The skilled in the art will understand that the disclosure can be implemented by various ways and is not limited to the preferred embodiments described here.

Figure 1A:
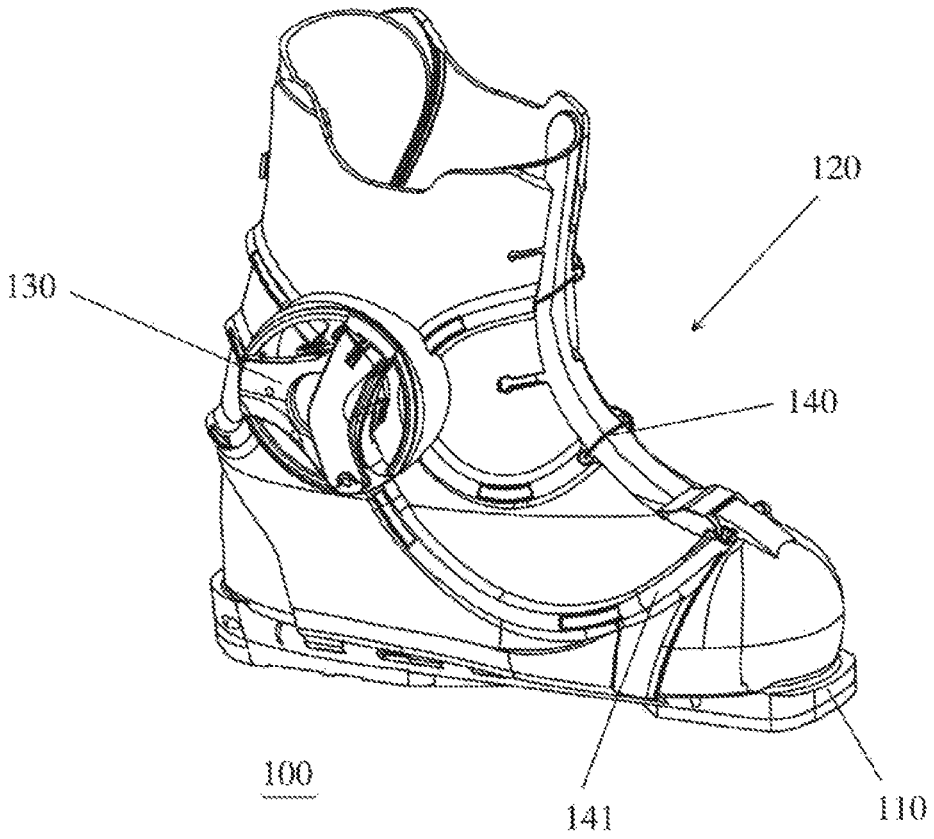
FIGS. 1A and 1B are two side views illustrating an embodiment according to the disclosure in which the ski boots are in closed state and the liner is omitted from the drawings.
Figure 4:
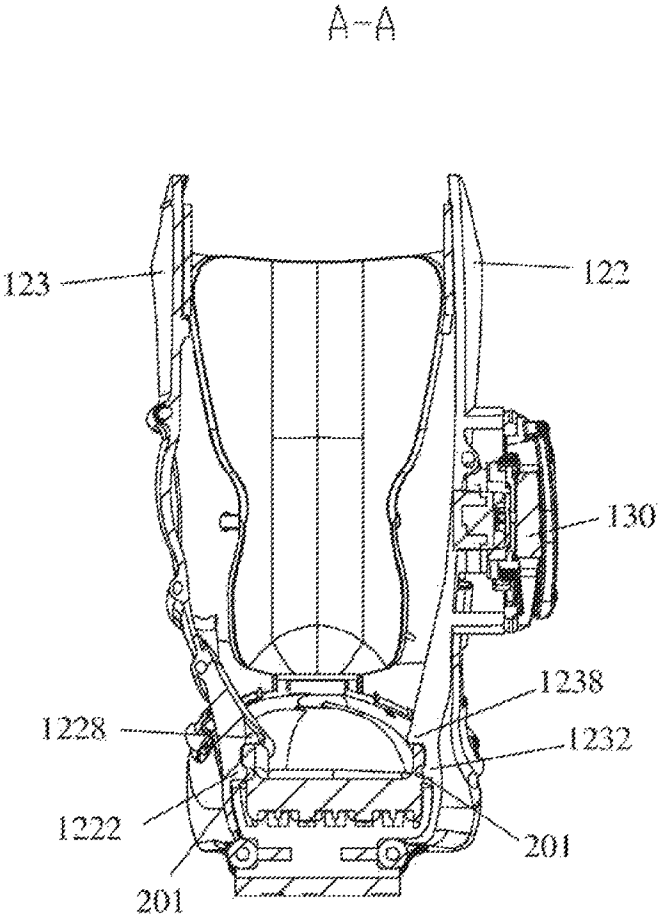
FIG. 4 is a sectional view illustrating the ski boot taken along A-A in FIG. 1B.
Figure 1B:
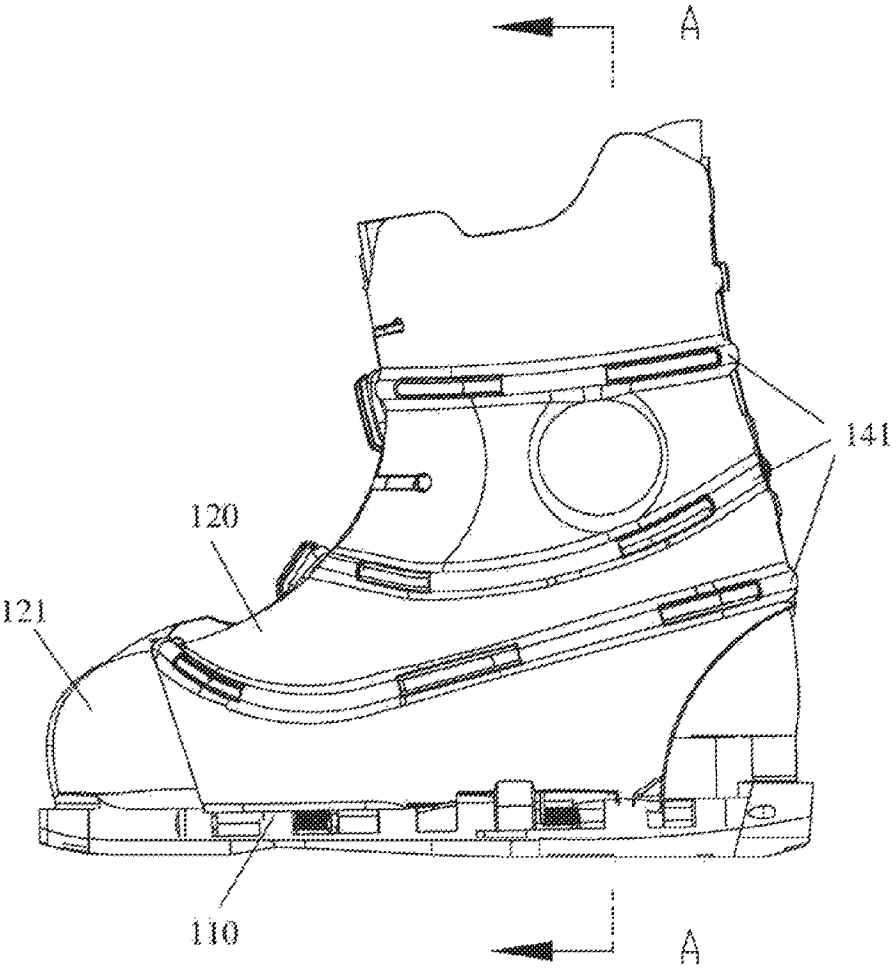
Figure 2:
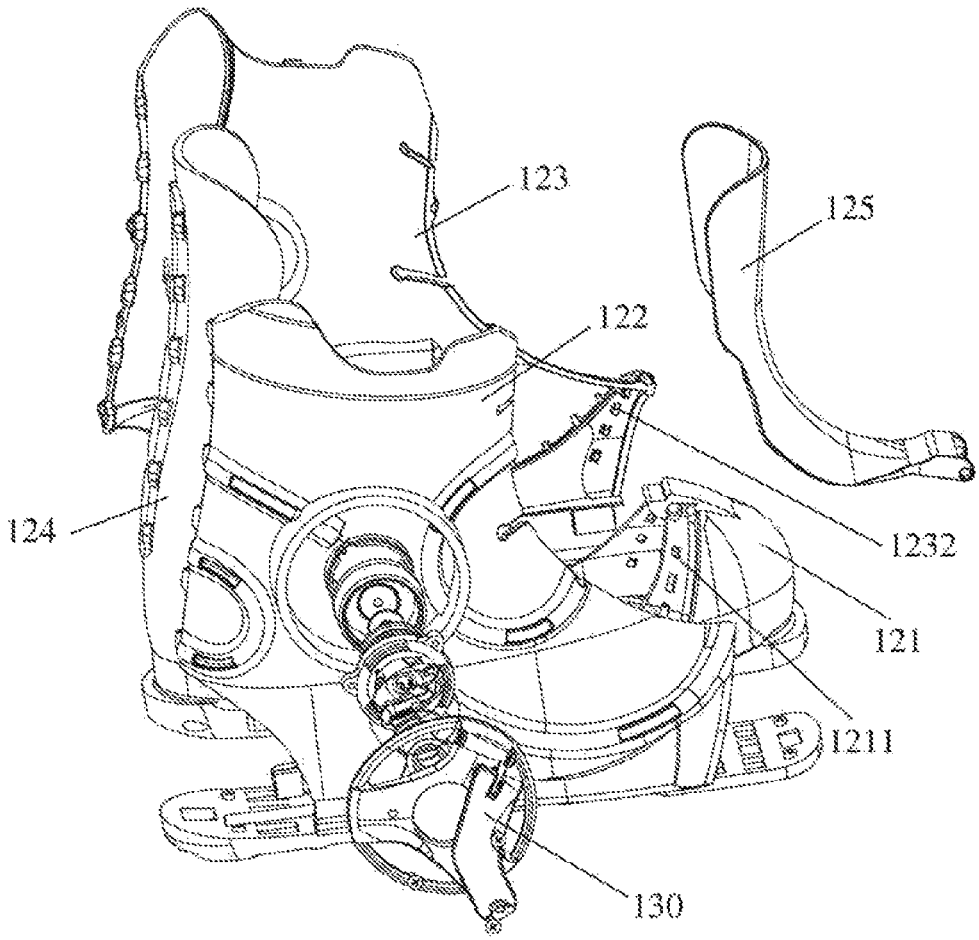
FIG. 2 is an exploded view illustrating a shell of the ski boots as shown in FIG. 1.

In the following description, the terms regarding directions such as "front", "rear", "left" and "right" are defined according to orientations when the right boot of the ski boots is placed as in FIG. 1, the forward direction is the direction from the heel to the toe cap, and the backward direction is opposite to the forward direction; and the inward or inner side is the direction pointing to the inside of the shoe, that is, the side of the shoe contacting the foot of the wearer when the wearer puts on the shoe; and the outward or outer side is the direction pointing to the outside from the inside of the shoe, that is, the side of the shoe facing away from the foot of the wearer when the wearer puts on the shoe. The left direction is the direction pointing to the left boot, and the right direction is the direction opposite to the left direction. Obviously, these limitations are simply for the purpose of better illustrating the disclosure. The disclosure is not limited to them. In addition, in the present application, the description is provided based on the example of the right boot of the ski boots. However, it can be understood that as a pair ski boots includes both the left and right boots, the left boot is the mirror image of the right boot and they constitute a structure of being mirror images for each other. Therefore, same description can be equivalently applied to the left boot of the ski boots.

As used in the disclosure, the usage of "one embodiment" or "this embodiment" is not intended to mean that the features described in one embodiment can only be used in this embodiment. Rather, the features in one embodiment can also be used in other embodiments or combine with the features in other embodiments so as to create a new embodiment, and all these embodiments fall within the protection scope of the disclosure.

A ski boot includes a shell 100 and a liner 200. As shown in FIG. 1, the shell 100 of the ski boot includes a sole 110, an upper 120, a lock 130 arranged on the upper 120 and a locking line 140 wound around the upper at a plurality of positions thereon.

The sole 110 includes a sole frame 1101 and a non-slipping block 1102 which is fixed onto a bottom surface of the sole frame 1101 so as for the sole 110 to meet the non-slipping requirement during walking on the snow and enhance the strength and wear resistance of the sole.

The upper 120 includes a toe cap portion 121, an upper right portion 122, an upper left portion 123, a heel portion 124 and a tongue portion 125. As shown in the figures, for example, the lock 130 may be arranged on the upper right portion 122 and located substantially at the middle level so as to facilitate the operation of the skier.

Figure 6B:
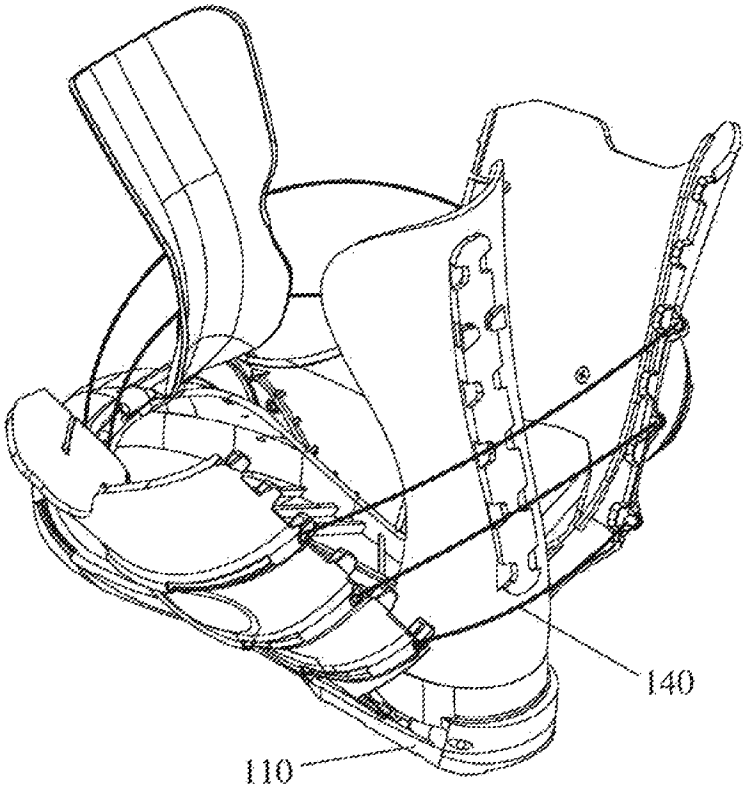
FIGS. 6A and 6B are perspective views illustrating the shell of the ski boots in an open state viewed from different angles.
Figure 6A:
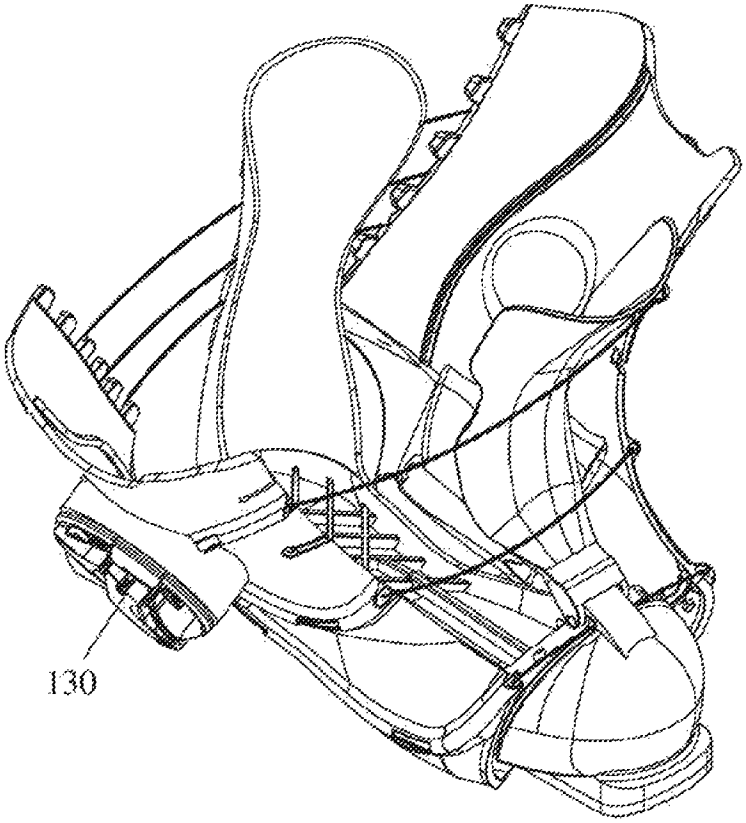
Figure 7:
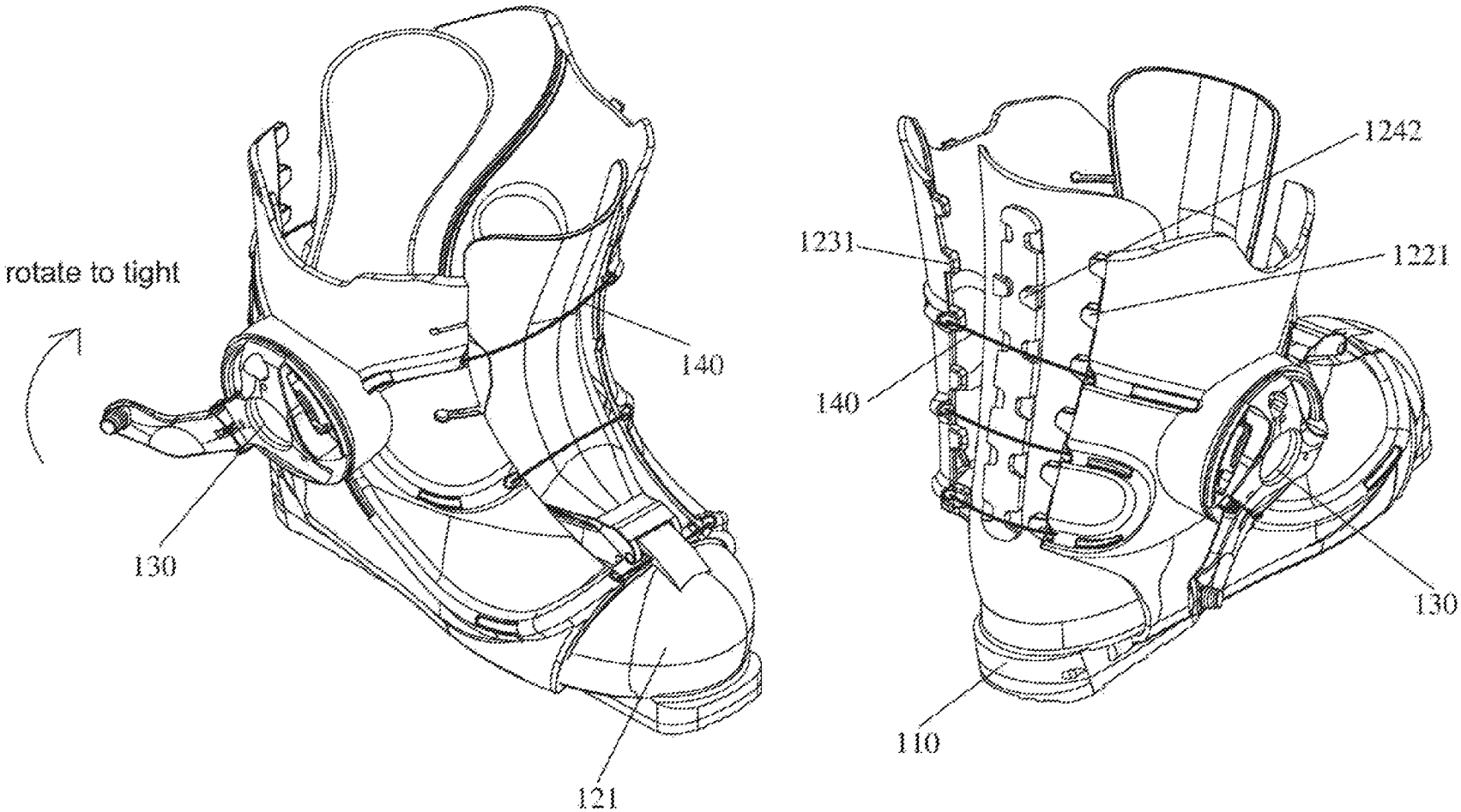
FIG. 7 is a perspective view illustrating the ski boot during the closing process viewed from different angles.

As shown, both the upper right portion 122 and the upper left portion 123 are articulated at the bottom thereof onto the sole 110. Therefore, they can be opened and closed relative to the sole 110. As shown in FIG. 1 in which the shell 100 is in the closed state in which the skier can snap the ski boots onto the ski board in the same way as regular ski boots; as shown in FIGS. 6A and 6B, the shell is in the opened state in which the upper right portion 122 and the upper left portion 123 open to a certain degree relative to the sole so as to allow the skier put the liner into the shell or take it off from the shell. Therefore, for example during the trip of the skier from the rest zone to the piste, the skier can wear the liner while holding the shell in hands or otherwise carrying it. Since the liner is more flexible than the shell, therefore the skier can move freely as if he was wearing regular shoes. Upon arriving at the piste, the skier can insert his feet with the liner into the shell while the shell 100 is in its opened state, put the shell into the closed state, and then snap the whole ski boots into the ski board. When the skier stops skiing or temporarily leaves the piste during skiing, the skier can simply place the shell into the opened state, take his feet with the liner out of the shell, and then freely walk.

Figure 3:
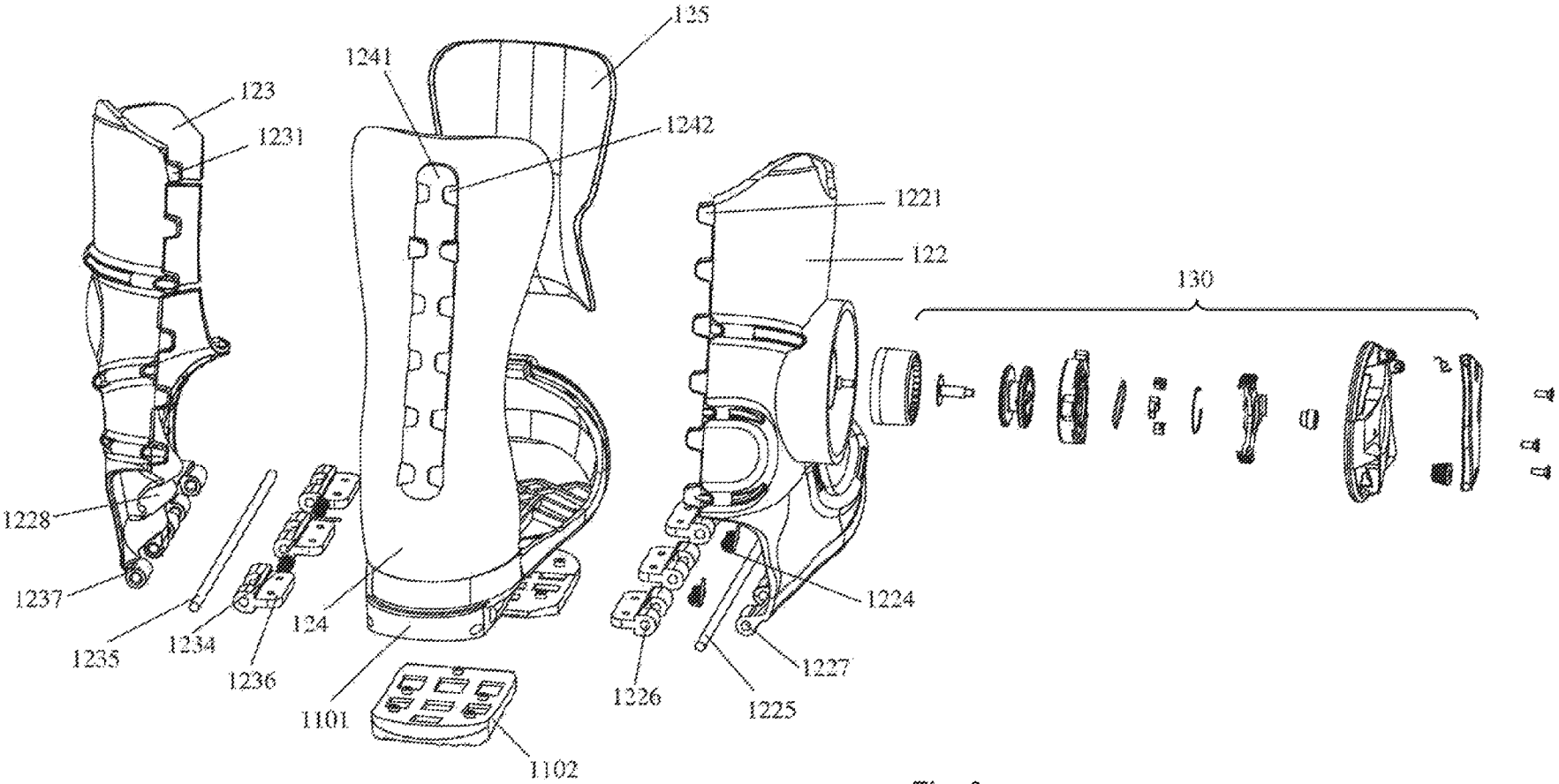
FIG. 3 is an exploded view of the shell of the ski boots as shown in FIG. 1 from an angle different from that of FIG. 2.

As shown in FIG. 3, both sides of the sole 110 are provided with hinge portions 1226 and 1236, and the bottoms of the upper right portion 122 and the upper left portion 123 are respectively provided with hinge portions 1227 and 1237 and hinge axles 1226 and 1236. The hinge axles respectively connect the hinge portions 1227 and 1237 of the upper right portion 122 and the upper left portion 123 with the hinge portions 1226 and 1236 on the sole 110, therefore constituting the hinge connection between the upper right portion and the upper left portion.

Referring to FIG. 3, in order to facilitate the opening of the upper left portion 123. Preferably, an opening spring 1234 is arranged near the position where the upper left portion 123 and the sole 110 are articulated and biases the upper left portion 123 toward the opened state. Similarly, it is also provided an opening spring 1224 at the corresponding position of the upper right portion 122.

The upper right portion 122 and the upper left portion 123 may connect to the sole 110 via hinge connection. However the disclosure is not limited to it. The skilled in the art may envisage any other means which connect the upper right portion and the upper left portion to the sole 110 via hinge connection, so that the upper right portion and the upper left portion can be put in the opened and closed states relative to the sole 110 easily.

In order to keep the upper right portion 122 and the upper left portion 123 in the closed state, the lock 130 and the locking line 140 are also provided, according to the disclosure. As shown, the locking line 140 starts from a reel (described below) in the lock 130, winds around a plurality of positions on the upper right portion 122 and the upper left portion 123, and finally returns to the reel (described below) in the lock 130 and winds on it. Therefore, by turning the reel of the lock 130, the locking line 140 can be wound in and tightened and the upper right portion and the upper left portion can be retained in the closed state by tightly winding the locking line 140 around the upper right portion and the upper left portion. In order to guide the locking line 140 on the plurality of positions of the upper right portion and the upper left portion and prevent the locking line from tangling or intervening with other objects (such as being stuck by the ski pole), a guiding tubes 141 may be formed on the upper right portion 122 or the upper left portion 123, preferably, the guiding tubes 141 are integrally formed with the upper right portion and the upper left portion. For example, a channel is formed within the material of the upper, or attached to the upper 110 as a separate part.

The upper 120 also includes a toe cap portion 121 on which a tongue portion 125 is articulated. The tongue portion 125 may turn around its lower end by which it articulates with the toe cap portion 121 along the forward and backward directions. Therefore, in the closed state, the tongue portion 125 may superpose under the upper right portion 122 and the upper left portion 123 at least partially. And in the opened state, the tongue portion 125 turns forwardly and provides more space for putting the liner in or taking it out. In addition, preferably, biasing means (not shown), such as a torsion spring, is arranged at the position where the toe cap portion 121 and the tongue portion 125 articulate, so as to bias the tongue portion 125 forwardly. Therefore, in the opened state, the tongue portion 125 automatically moves forward, i.e., turns toward the direction of the toe cap, clearing the space for the liner to be put in or taken out.

The upper 120 also includes a heel portion 124 which is fixedly erected on the sole 110 so as to provide support for the liner. That is to say, the heel portion 124 is stationary in both the opened and closed states. And in the closed state, the heel portion 124 superposes under the upper right portion 122 and the upper left portion 123 at least partially.

During skiing, especially doing some ski actions or turning, the ski boots may be subject to a significant side force, which tends to deflect the upper right portion and the upper left portion relative to the heel portion, e.g. along the up and down direction. In order to overcome this problem and retain the position of the upper right portion 122 and the upper left portion 123 when they are in the closed state, a fixation device is provided according to the disclosure.

As clearly shown in FIG. 3, the fixation device includes, on the heel portion 124, a positioning strip 1241, which is arranged along the heel portion 124, and at opposite sides of the positioning strip 1241, a plurality of positioning slots 1242 are formed at predetermined distances. To engage with the positioning slots 1242, the rear edges of the upper right portion 122 and the upper left portion 123 are respectively provided with a plurality of corresponding protrusions 1221 and 1231. As shown in FIG. 3, when the upper right portion 122 and the upper left portion 123 are closed, the plurality of protrusions 1221 and 1231 are engaged in the positioning slots 1241 respectively, so as to prevent the upper right portion 122 and the upper left portion 123 from moving up and down.

Although it is described that the positioning slot is formed on the positioning strip and the protrusions are formed on the upper portion, this arrangement can be reversed without departing from the disclosure.

Advantageously, the fixation device also includes a plurality of positioning recesses 1211 arranged on the edge of the toe cap portion 121. Corresponding to the positioning recesses 1211, the front edges of the upper right portion 122 and the upper left portion 123 are provided with a plurality of protrusions 1222 and 1232 respectively. When the upper right portion 122 and the upper left portion 123 are closed, the protrusions 1222 and 1232 are engaged into the positioning recesses 1211 respectively, therefore preventing the upper right portion 122 and the upper left portion 123 from moving up and down.

Although it is described that the positioning recesses are arranged on the toe cap portion and the protrusions are formed on the upper portion, obviously this arrangement can be reversed without departing from the teaching of the disclosure and thus fall within the scope of the disclosure.

Figure 5A:
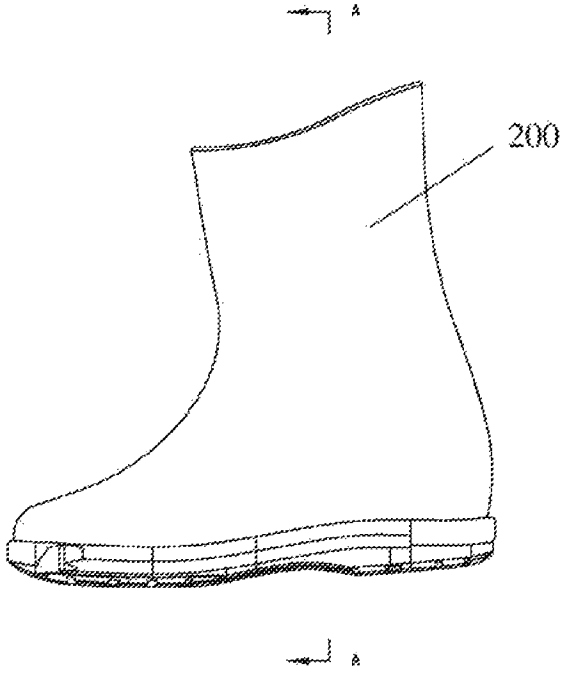
FIGS. 5A to 5C are respectively a side view illustrating the liner, a sectional view taken along the line A-A of FIG. 5A and a detailed view of the position as shown in the circle of FIG. 5B.
Figure 5B:
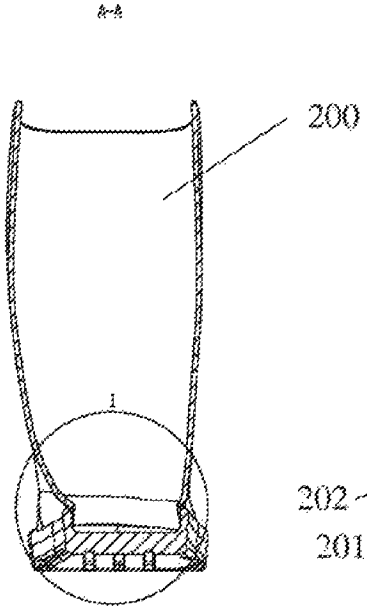
Figure 5C:
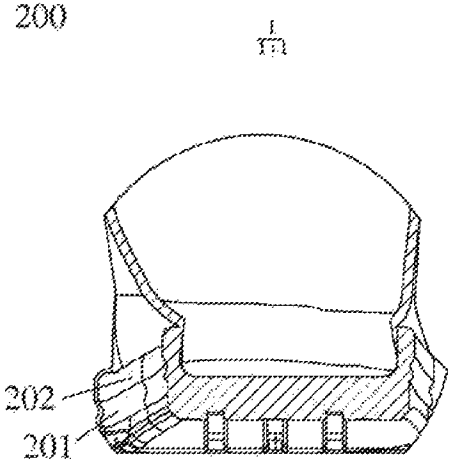

Referring to FIGS. 5A to 5C, the liner 200 which may be used with the above shell 100 is described.

The liner 200 comprises various soft lining materials so as to guarantee heat insulation, waterproofing and convenience. However, a sole of the liner may be made of stiff rubber or synthetic material so that the skier can merely wear the liner and walk on the snow or ground. In order to prevent the liner 200 from shaking in the shell 100, referring to FIG. 4 and FIGS. 5A to 5C, slots 2001 are formed at both sides of the sole of the liner 200. Correspondingly, tabs 1222 and 1223 are arranged at the corresponding positions in the lower portion of the upper right portion 122 and the upper left portion 123 of the shell 100. When the upper right portion 122 and the upper left portion 123 are put into the closed state, the tabs 1222 and 1223 are pressed into the slots 2001, so as to prevent the liner 200 from moving inside the shell 100.

Alternatively or additionally, inside the upper right portion 122 and the upper left portion 123 of the shell, bosses 1238 and 1228 are formed. Therefore when the upper right portion 122 and the upper left portion 123 are closed, the bosses 1238 and 1228 are pressed against the sole of the liner so as to prevent the liner from moving.

Alternatively or additionally, tabs (not shown) are also formed on the surface of the sole of the liner and may insert into the space formed in the frame of the sole of the shell. Therefore, the liner is further prevented from moving in the shell.

Now referring to FIG. 8 to FIG. 15, the lock 130 according to the embodiment will be explained in detail.

Figure 8:
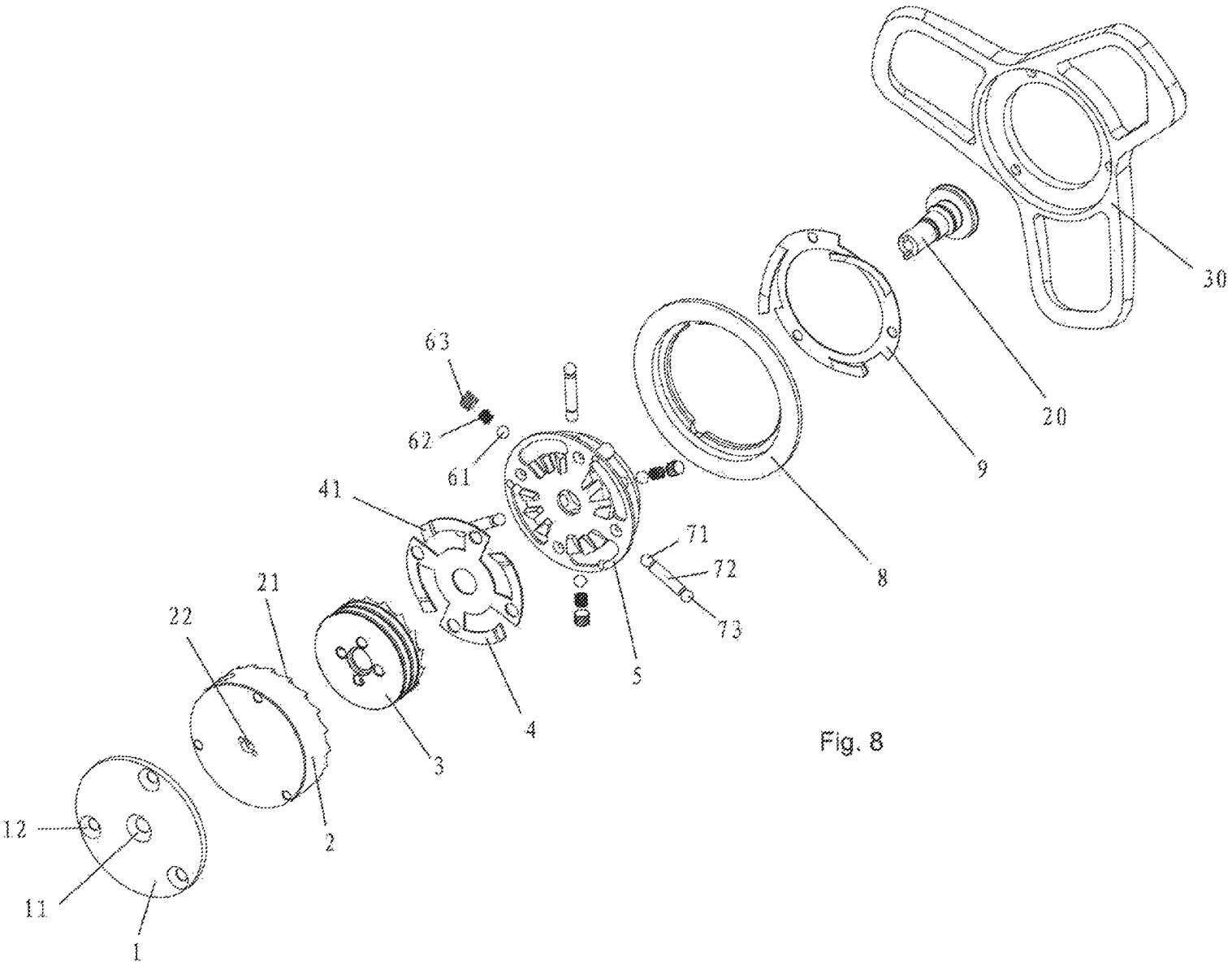
FIG. 8 is an exploded and perspective view illustrating a lock of the ski boot as shown in FIG. 1.

Referring to FIG. 8, FIG. 8 shows an exploded and perspective view of the lock 130. The lock 130 includes a fixing sheet 1. The fixing sheet 1 is arranged inside the upper right portion 122 of the shell 100, sandwiches the material of the upper right portion with a locking sleeve 2 which is placed outside the upper right portion 122, and is fastened with the locking sleeve 2 for example by riveting or screwing, thus fixing the locking sleeve 2 on the upper right portion. For example, as shown in FIG. 8, the fixing sheet 1 and the bottom of the locking sleeve 2 are provided with a plurality of holes 12, 23 (three in the figures). Rivets or screws (not shown) pass through the corresponding holes and tighten the same on the material of the upper right portion 122. Therefore, the locking sleeve 2 is secured on the upper right portion.

Figure 9A:
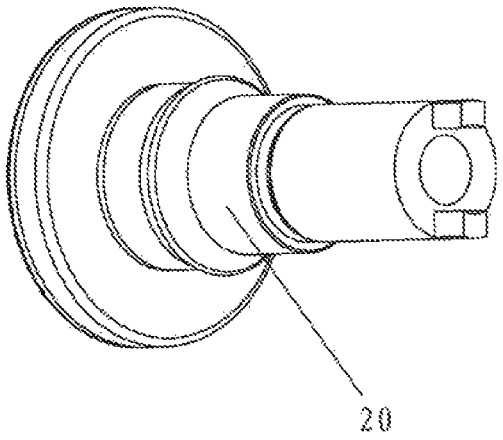
FIG. 9A and FIG. 9B are a side view and a perspective view illustrating a main shaft of the lock as shown in FIG. 8.
Figure 9B:
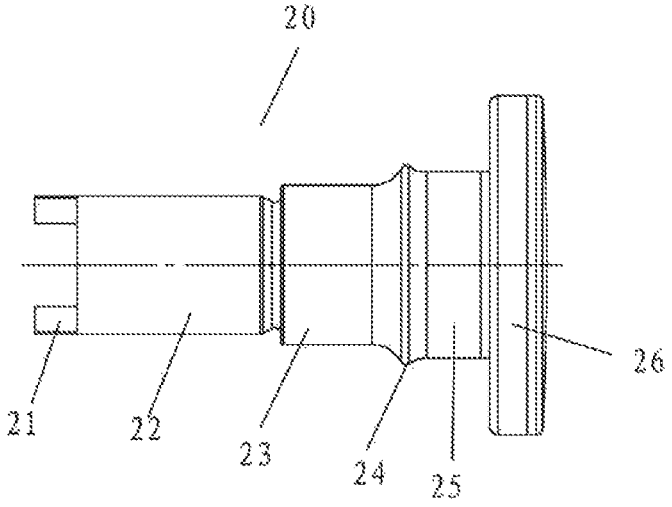
Figure 10:
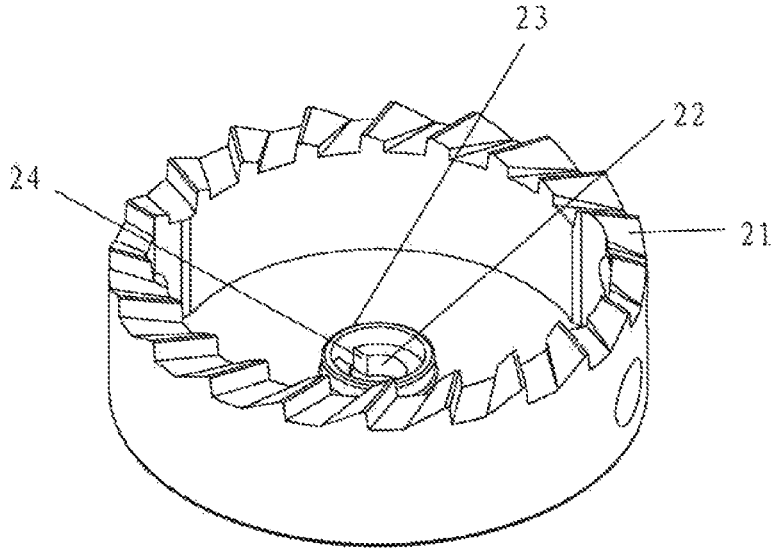
FIG. 10 is a perspective view illustrating a locking sleeve in the lock of FIG. 8.

Also referring to FIG. 10, the fixing sheet 1 also includes a thorough hole 11 at the centre. An annular boss 23 is arranged at the bottom inside the locking sleeve 2 and a key groove 24 is arranged inside the boss 23. Also, a thorough hole 22 is arranged at the centre of the bottom of the locking sleeve 2. As shown in FIGS. 9A and 9B, two protrusions 201 are formed at one end of a main shaft 20 and can be inserted into the above key groove 24 so as to prevent the main shaft 20 from turning. A screw (not shown) passes from the fixing sheet 1 through the thorough hole of the fixing sheet 1, the material of the upper right portion and the thorough hole 22 of the bottom of the locking sleeve 2 and screws into the threaded hole of the end of the main shaft. Therefore, the main shaft 20 is secured to the locking sleeve 2 and prevents the main shaft 20 from rotating relative to the locking sleeve 2.

As shown in FIGS. 9A and 9B, the main shaft 20 includes a first diameter section 202, a second diameter section 203, a ridge 204, a third diameter section 205 and an end cover 206.

Figure 11:
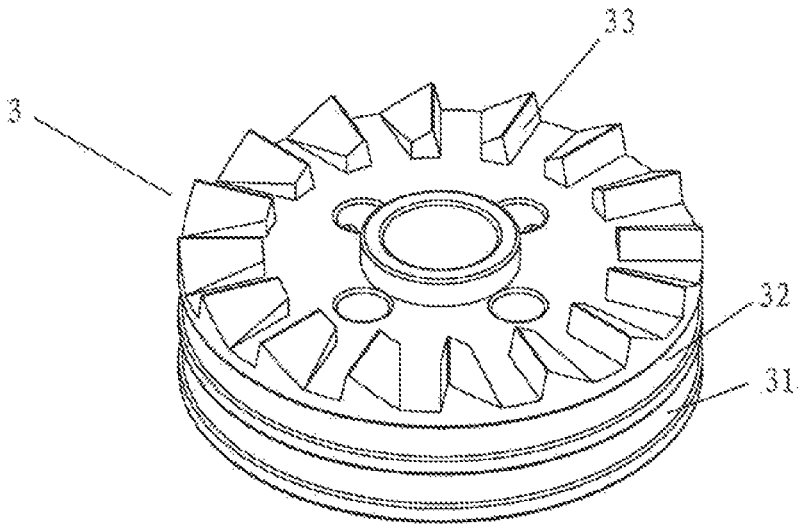
FIG. 11 is a perspective view illustrating a reel in the lock of FIG. 8.

As shown in FIG. 11, the reel 3 is placed concentrically relative to and inside the locking sleeve 2. And the reel 3 is nested on the first diameter section 202 of the main shaft 20 rotatably so that the reel 3 may turn so as to wind the locking line 140 when needed. The reel 3 has two grooves 31 and 32 on its outer circumference. The two end portions of the locking line 140 are secured inside the two grooves 31, 32 respectively. And thus, the locking line 140 is retracted or released as the reel 3 rotates.

As shown in FIGS. 10 and 11, ratchets 21 are formed on the edge of the locking sleeve 2 and ratchets 33 are arranged on the outer end face of the reel 3. When the reel 3 is housed in the locking sleeve 2, ratchets 21 and ratchets 33 substantially lie in the same plane. In addition, the ratchets 33 of the reel 3 and the ratchets 21 of the edge of the locking sleeve 2 are inclined with opposite angles.

Figure 12C:
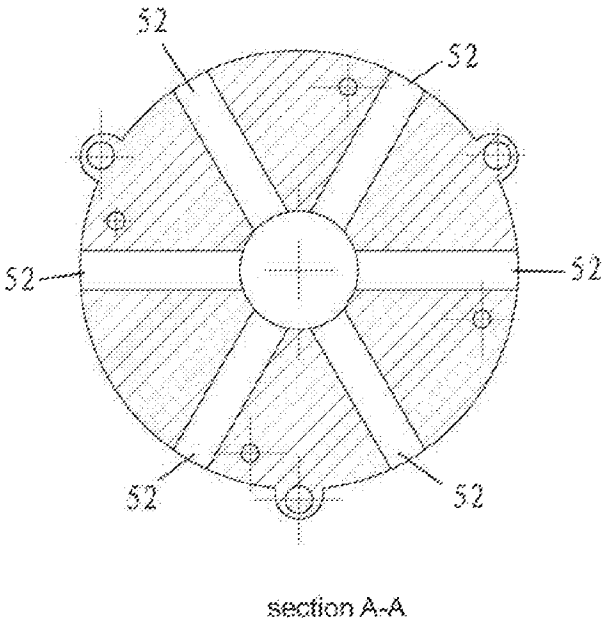
FIGS. 12A to 12C are a perspective view, a side view illustrating a clutch of the lock of FIG. 8 and a sectional view taken along A-A of FIG. 12B.
Figure 12B:
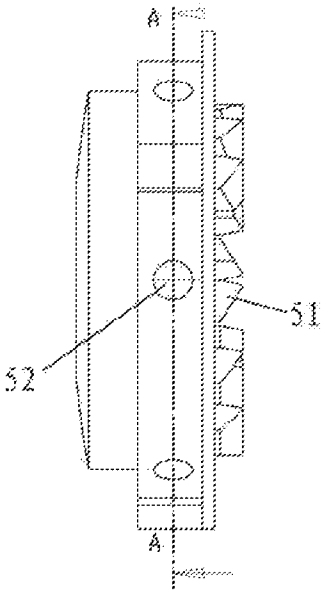
Figure 12A:
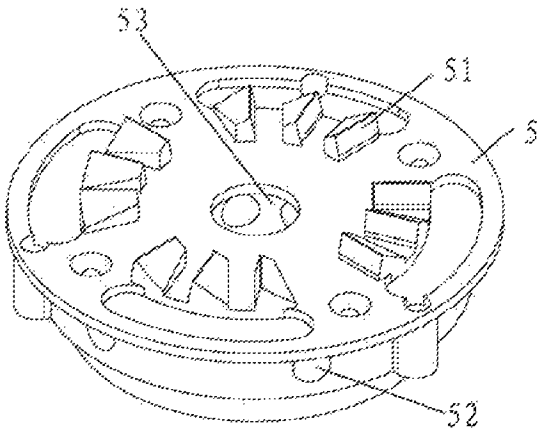

A clutch 5 is rotatably and axially slidably on the main shaft 20. In particular, the clutch 5 has a central thorough hole 53. And the main shaft 20 passes through the central thorough hole 53 so that the clutch 5 may pass over the ridge 204 from the second diameter section of the main shaft 20 and slide onto the third diameter section 205, vice versa. As shown in FIG. 12A to 12C, the clutch 5 is provided with claws 51 on a first end face of the reel 3. The position where the claws 51 are provided correspond to the position of the ratchets 33 on the reel 3, so as to engage with the ratchets 33. In addition, a claw sheet 4 is also mounted on the first end face (as shown in FIG. 8), which is secured onto the clutch 5 for example via the four holes on the outer periphery by means of screws. The claw sheet 4 has a diameter similar to that of the locking sleeve 2 and has four claws on its outer periphery. The four claws 41 may engage with the ratchets 21 of the locking sleeve 2. Therefore, as the clutch 5 slides from the second diameter section 203 onto the third diameter section 205 along the main shaft 20, the claws 51 and the claws 41 are released from the ratchets 33 and ratchets 21 respectively. And as the clutch 5 slides from the third diameter section 205 to the second diameter section 203 along the main shaft 20, the claws 51 and the claws 41 are engaged with the ratchets 33 and ratchets 21 respectively. It should be pointed out that even though the claws 41 and the claws 51 are arranged respectively on the claw sheet 41 and the clutch 5 and then the claw sheet 41 is mounted on the clutch 5 in the embodiment, the claw sheet can be omitted and both the claws 41 and 51 are directly formed on the clutch according to the disclosure, which falls within the scope of the disclosure.

In order to hold the position of the clutch 5 on the main shaft and in order to provide for the skier a feeling that the clutch 5 moves its position, channels 52 are equidistantly formed on the clutch 5 around the outer periphery as shown in FIG. 12C. The channels 52 radially extend to the central thorough hole 53 of the clutch 5 from the peripheral face of the clutch 5. As shown in FIG. 12C, a total of six channels 52 are provided. Within the six channels 52, every two channels 52, that is, three channels which are equidistantly positioned around the circumference are provided with positioning means. The positioning means include a ball 61, a spring 62 and a fastening screw 63. The fastening screw 63 is secured on the channel 52 for example by means of screwing and the ball 61 is pressed against the periphery of the main shaft 20 under the action of the spring 62, therefore keeping the position of the clutch 5 on the main shaft 20 unchanged. During the process that the clutch 5 slides from the second diameter section of the main shaft 20 to the third diameter section, when passing the ridge 24 of the main shaft, the ball 61 compresses the spring 62 which is released after crossing over the ridge 204. Thus a feeling of "clicking" is generated.

Figure 13:
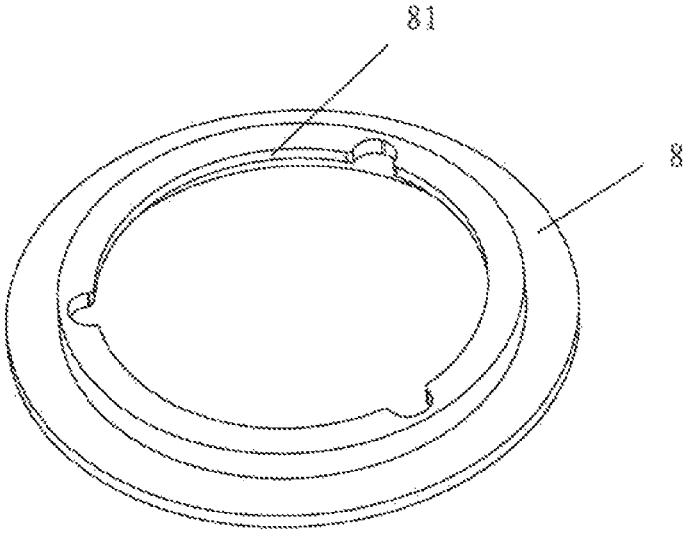
FIG. 13 is a perspective view illustrating a locking ring in the lock of FIG. 8.

Locking means are also provided on the clutch 5, the locking means includes a locking system and a locking ring 8 arranged around the other three channels 52 which are not occupied by the positioning means. The locking system includes inner rolling balls 71, locking pins 72 and outer rolling balls 73. As shown in FIG. 13, the locking ring 8 is in an annular shape and surrounds the outer periphery of the clutch 5, and can move between a locking position and an unlocking position. In particular, referring to FIGS. 15A to 15C, in the locking position, the locking ring 8 is sleeved on the clutch 5, and the locking face 81 of the locking ring 8 is located outside the outer rolling ball 73 and prevents the locking system from moving outward along the channel 52. As such, when the clutch 5 for example is to slide from the second diameter section to the third diameter section, the inner rolling ball 71, the locking pin 72 and the outer rolling ball 73 of the locking system is blocked by the locking face 81 of the locking ring 8 so that they cannot move outward. Therefore the inner rolling ball 71 is blocked by the ridge 24 of the main shaft 20 and thus cannot cross over the ridge 24, resulting in that the entire clutch 5 cannot slide axially along the main shaft 20. However, when the locking ring 8 slides outward along the main shaft 20 (in this embodiment, toward the direction of the third diameter section) so that the locking face 81 moves away from the blocking position, referring to FIGS. 16A to 16C, since the locking system is no longer blocked and can slide outward, the clutch 5 can cross over the ridge 24 and moves onto the third diameter section 25 of the main shaft 20.

Figure 14:
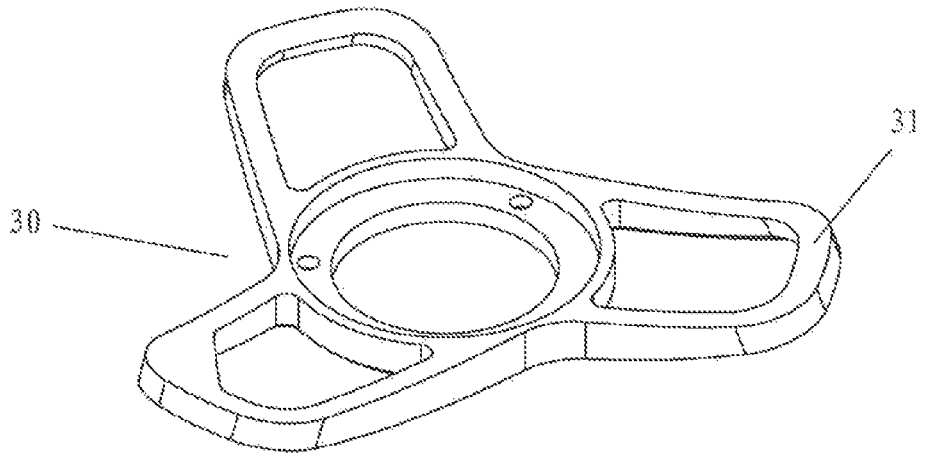
FIG. 14 is a perspective view illustrating a handle in the lock of FIG. 8.

The clutch 5 is connected with a handle 30 (as shown in FIG. 14) by means of screws (not shown) and the locking ring is arranged between the clutch 5 and the handle 30. The handle 30 is provided on the inner face, i.e., the face facing the clutch, with a leaf spring 9 which biases the locking ring 8 toward the locking position. The handle 30 includes three leaf shaped gripping portions 31 for being hold by the skier. In addition, a crank 32 (as shown in FIG. 1) is also arranged on one of its three gripping portions 31 for easy turning of the handle 30.

The main shaft 20 also includes an end cap 206 so as to prevent the parts arranged on the main shaft 20 from detaching therefrom.

Referring to FIGS. 15A to 16B, the operation of the lock and the shell is described.

Figure 15A:
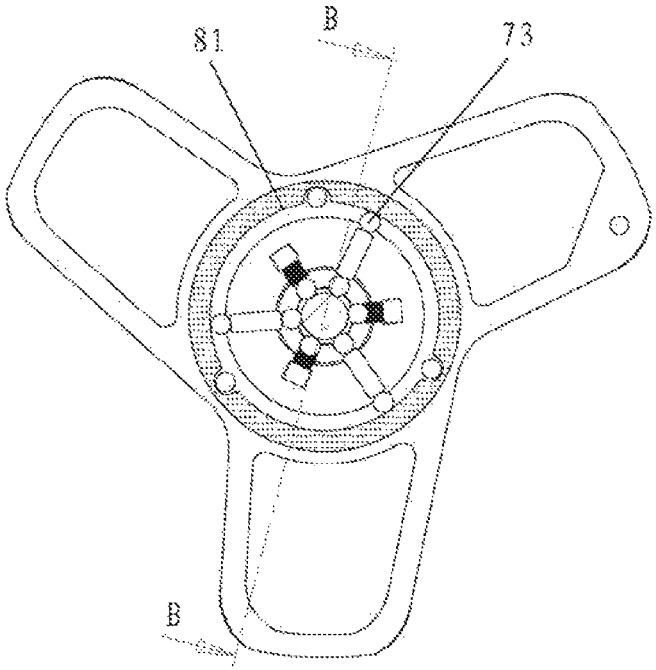
FIGS. 15A to 15C are respectively schematic views of the lock as shown in FIG. 8 in a locking state.
Figure 15B:
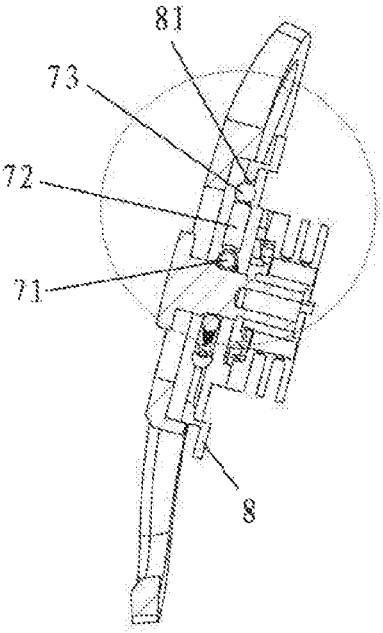
Figure 15C:
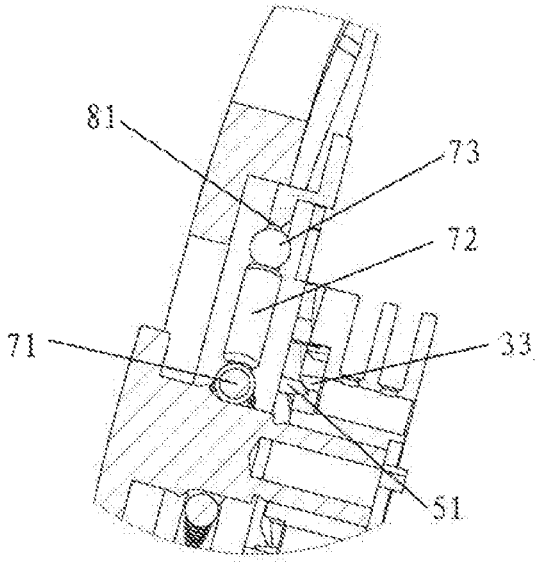

When the shell 100 is in the opened state, the skier can insert his/her foot with the liner into the shell 100. When the liner 200 is placed in position, the skier can slide the clutch 5 into the locking position, that is, onto the second diameter section of the main shaft 20 and turn the handle 30 for example in a first direction. At this moment, the locking ring 8 is biased to the locking position by the leaf spring 9 (as shown in FIGS. 15A and 15B), and the clutch 5 is on the second diameter section of the main shaft 20. And the claws 51 of the clutch 5 mesh with the ratchets 33 of the reel 3 and the claws 41 of the claw sheet 4 mesh with the ratchets 21 of the locking sleeve 2. However, since the ratchets 33 and the ratchets 21 are in opposite directions, when the handle 30 turns, the claws 51 drive the reel 3 to rotate in a first direction. But the claws 41 slide on the ratchets 21 of the locking sleeve 2 without being jammed. Therefore, the rotating reel 3 retracts the locking line 140 so as to tighten the upper right portion 122 and the upper left portion 123 of the shell 100 into the closed state. Thanks to the fact that the claws 41 mesh with the ratchets 21 of the locking sleeve 2, even if the skier releases the handle 30, the clutch 5 is prevented from rotating in a second direction opposite to the first direction and the reel 3 is further prevented from rotating in the second direction and causing the locking line 140 to become loose.

Figure 16A:
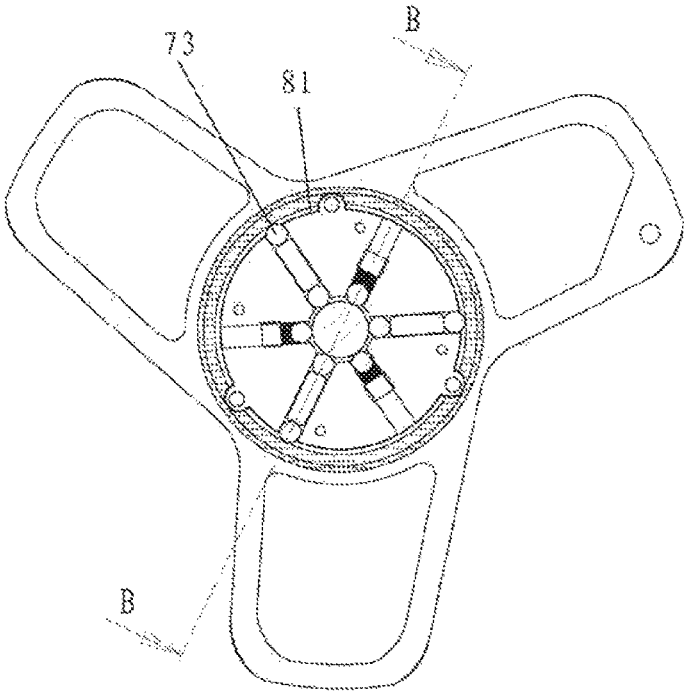
FIGS. 16A to 16C are respectively schematic views of the lock as shown in FIG. 8 in an unlocking state.
Figure 16B:
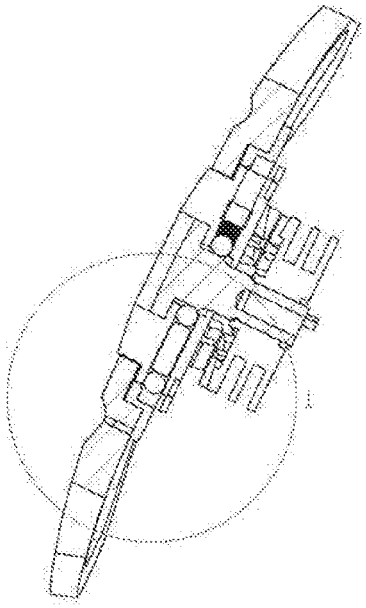
Figure 16C:
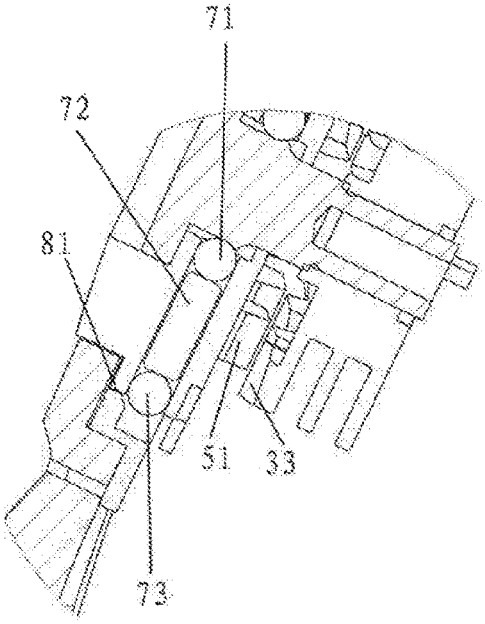

When the skier wants to take off the shell 100, he holds the locking ring 8 and pulls it outward so that the locking ring 8 is pulled to the unlocking position by overcoming the elasticity of the leaf spring 9. As shown in FIGS. 16A and 16B and in this state, the locking system of the clutch 5 is released, the clutch 5 and the handle 30 are pulled outward together. Therefore the claws 51 of the clutch 5 and the claws 41 of the claw sheet 4 are released from the ratchets 33 on the reel 3 and the ratchets 21 of the locking sleeve 2, so that the reel 3 can rotate freely. And by means of the spring force of the opening springs 1224, 1234 of the upper right portion 122 and the upper left portion 123, the upper right portion 122 and the upper left portion 123 are turned to the opened state so that the skier may easily take off the liner 200.

The above describes the embodiment in which the lock is locked or unlocked by translating the locking ring 8 along the main shaft 20, however, the disclosure is not limited to it. For example, the locking ring 8 may be arranged so as to rotate around the main shaft 20 between the locking position and unlocking positions so as to lock and unlock the lock. Referring to the drawings, a lock according to another embodiment of the disclosure is described in which same or similar elements with the previous embodiment adopt same references and the repeated description thereof is avoided.

Figure 17:
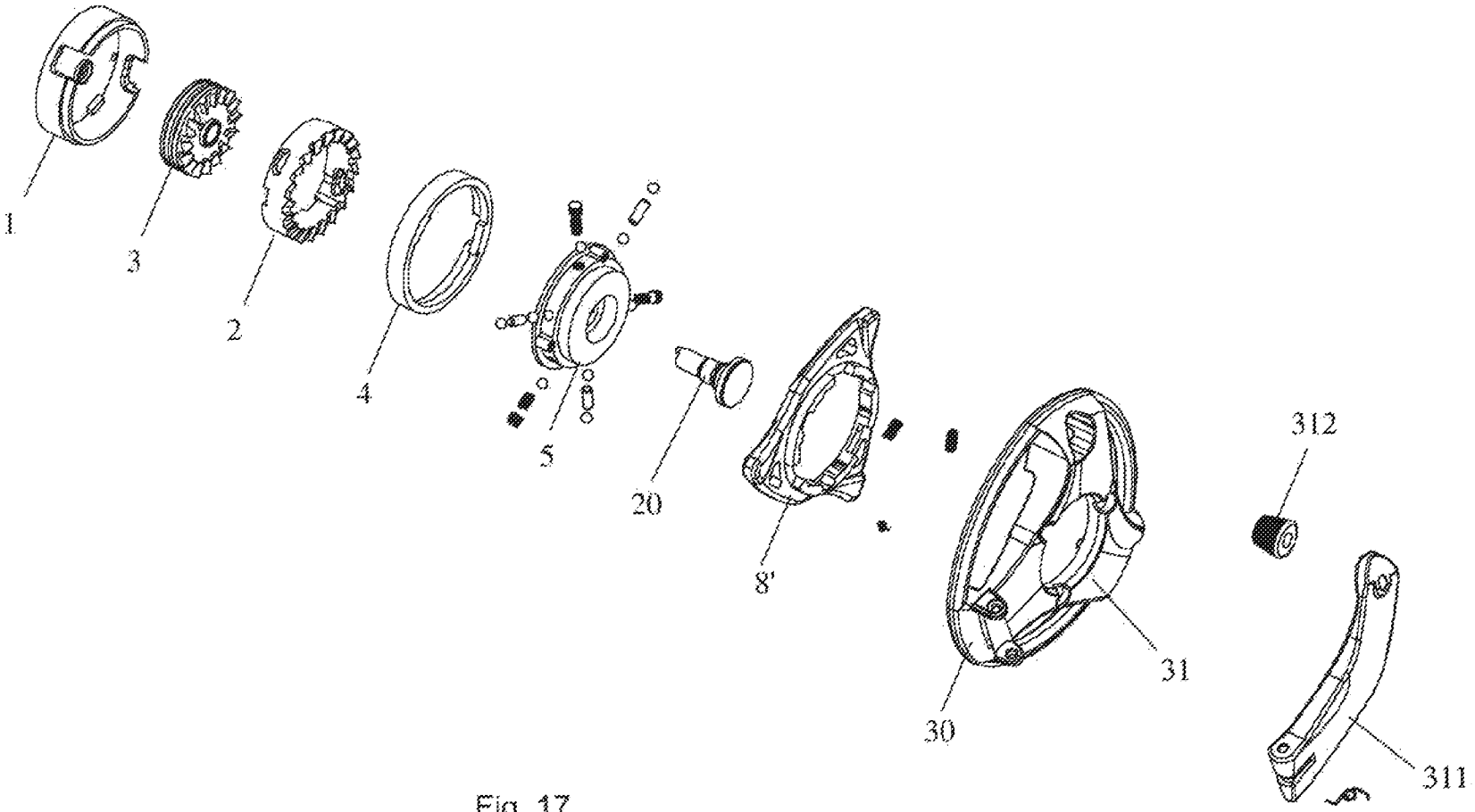
FIG. 17 is an exploded and perspective view illustrating a lock according to another embodiment of the disclosure.

FIG. 17 is an exploded and perspective view illustrating a lock according to a second embodiment of the disclosure; and FIG. 18 is a perspective view of the locking ring.

The lock as shown in FIG. 17 is substantially identical with that of FIG. 8 except that the locking ring is a rotating type. Therefore, the following merely describes in detail for difference of the second embodiment.

Figure 18B:
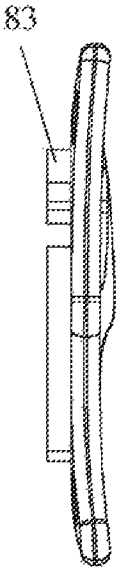
FIGS. 18A and 18B are views illustrating a locking ring in the lock as shown in FIG. 17.
Figure 18A:
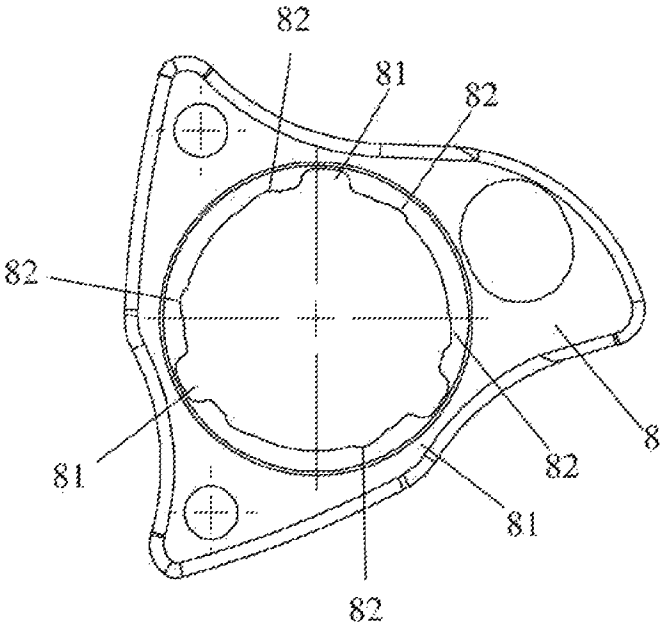

In combination with FIGS. 18A and 18B, referring to FIG. 17, the fixing sheet 1 is formed as a sleeve as shown in FIG.

17, and the locking sleeve 2 is inserted into the fixing sleeve 1 and the locking sleeve 2 cannot rotate due to the restriction of the bosses. Two notches are oppositely provided on the peripheral wall of the fixing sleeve 1 so as to allow the tightening line to go in and out. A strengthening ring 4 is further arranged which is covered on the sleeve 1 so as to close the notches and strengthen the structure of the fixing sleeve 1.

The locking ring 8' is shaped substantially as a clover with a circular opening (not referenced) in the centre. Therefore the locking ring 8' surrounds around the outer periphery of the clutch 5 and rotates around the outer periphery of the clutch 5. As shown in FIG. 18, a plurality of slots 81 (three in the drawing) are formed on the circumference of the circular opening. When the locking ring 8' is sleeved on the clutch 5, the cylindrical bosses (not referenced) on the outer surface of the clutch 5 may be inserted into the slots 81. Therefore, as the locking ring 8' rotates, the cylindrical bosses may move within the slots 81 so as to limit the rotating range of the locking ring 8'. In addition, corresponding to the locking system in the clutch 5, a plurality of cam slots 82 which are spaced by a plurality of uniform spaces are also formed on the circumference of the locking ring 8'. As the locking ring 8' rotates, the outer rolling ball 73 of the locking system of the clutch 5 may slide along the cam slots 82. A plurality of bosses 83 are also formed on the circumference of the circular opening. After the locking ring 8' is sleeved on the periphery of the clutch 5, the bosses 83 face the handle 30 and the corresponding positions of the handle 30 also form bosses (not shown), so that springs 84 are arranged between the bosses of the handle and the bosses of the locking ring 8' which bias the locking element toward the locking position.

Figure 19:
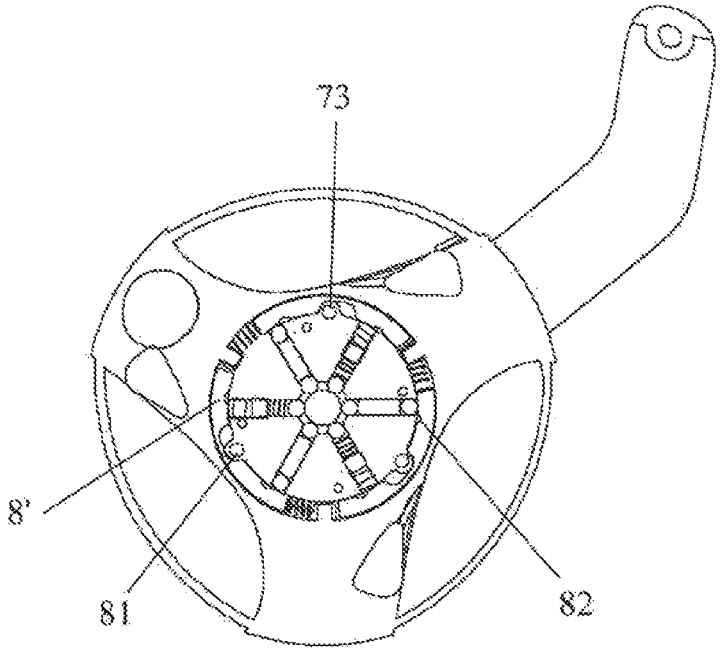
FIG. 19 is a sectional view seen from the top illustrating the lock as shown in FIG. 17 in the locking state.
Figure 20:
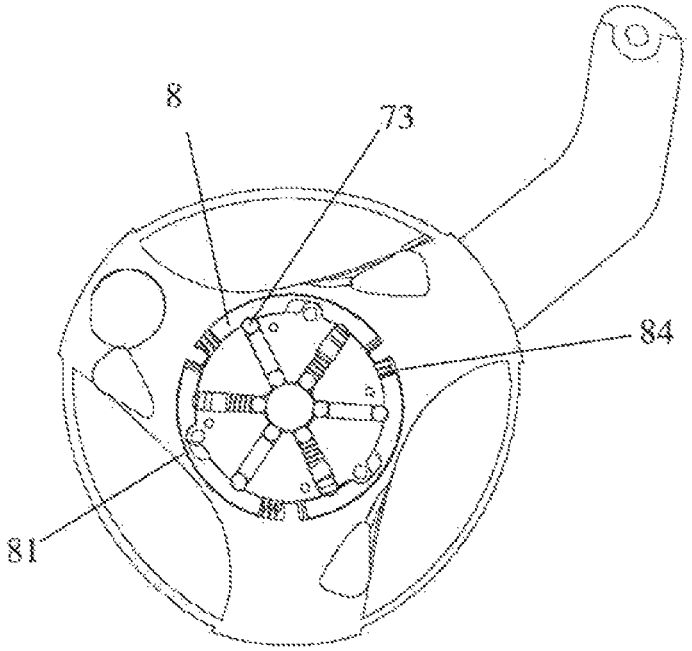
FIG. 20 is a sectional view seen from the top illustrating the lock as shown in FIG. 17 in the unlocking state.

Now the operational principle of the lock according to the embodiment will be explained with reference to FIGS. 19 and 20. As shown in FIG. 19 which shows the locking ring 8' in the locking position. In that position, the locking ring 8' is kept in the shallowest position of the cam slots 82 on the periphery of its circular opening against the locking position of the locking system of the clutch 5. Therefore the inner rolling balls 71, the locking pins 72 and the outer rolling balls 73 are rested against so that they cannot move outward and thus the clutch 5 cannot move along the main shaft 20, as explained in the previous embodiment. When the locking ring 8' is rotated by overcoming the biasing force of the springs 84, as shown in FIG. 20, the outer rolling balls 73 of the locking system slide along the cam slots 82 of the locking ring 8' and enter into the deepest portion of the cam slots 82. At this moment, the inner rolling balls 71, the locking pins 72 and the outer rolling balls 73 of the locking system can move outward and release the clutch 5. Therefore as explained in the previous embodiment, the clutch 5 may move along the main shaft 20 and release the lock.

In addition, as shown in FIG. 17, the handle 30 is in a circular shape and includes for example three spokes 31. One of the spokes 31 includes a folding gripping portion 311 which is connected with a gripping portion of the handle 30 by an articulating axle. A crank 312 is provided on a free end of the folding gripping portion 311. When not being used, the folding gripping portion 311 may be folded onto the gripping portion 31 of the handle 30 and the crank 312 is inserted into the hole formed in the gripping portion 31 so as not to intervene with other objects. When being used, the folding gripping portion 311 may be deployed, and the handle 30 may be rotated via the crank 312.

By utilizing the folding gripping portion 311, on one hand, it can be folded into the handle 30 when not being used so as not to intervene with exterior objects (or the locking lines); while on the other hand, it can be deployed outside the handle 30 so as to increase the moment for rotating the handle 30 so as to facilitate the closing of the shell of the ski boots.

Figure 21:
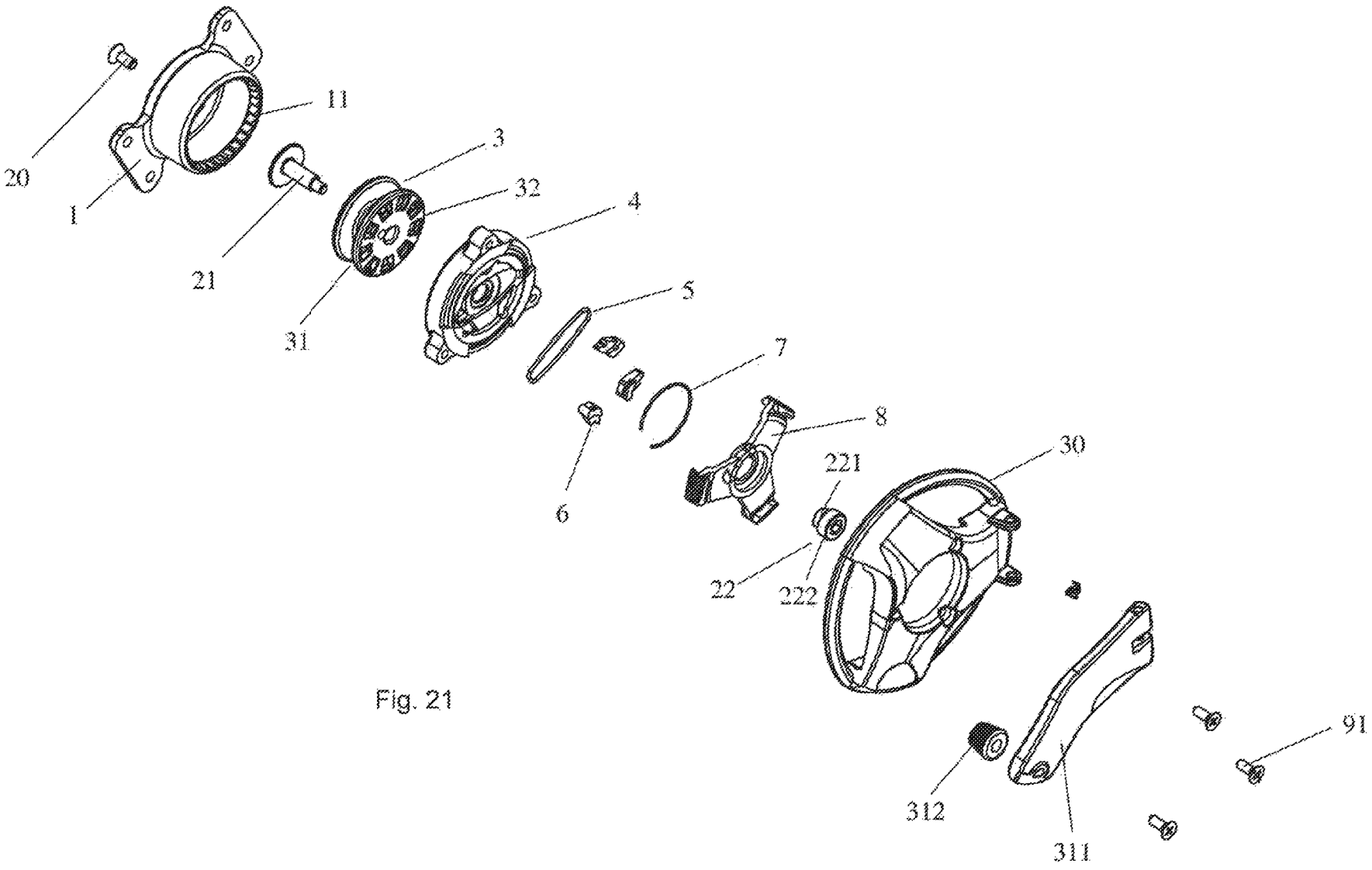
FIG. 21 is an exploded and perspective view of a lock according to the third embodiment of the disclosure.
Figure 22A:
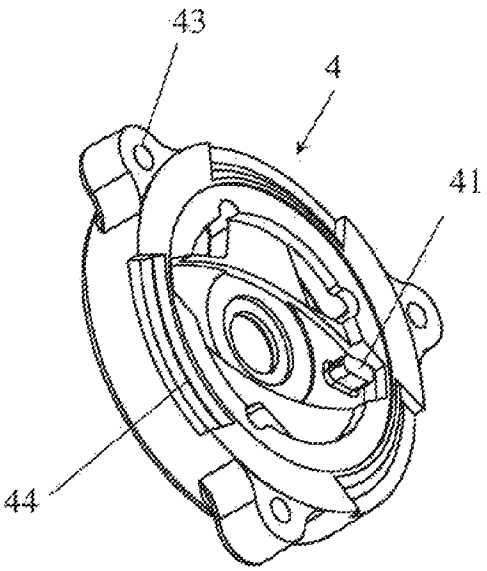
FIGS. 22A and 22B are the perspective views of the retracting tooth cover in the lock from two angles.
Figure 22B:
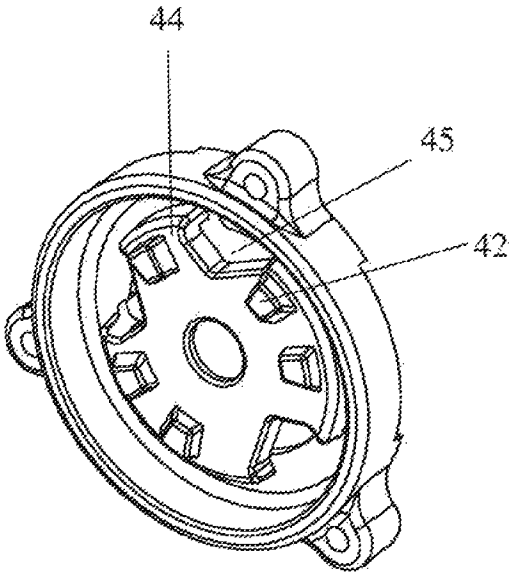
Figure 23:
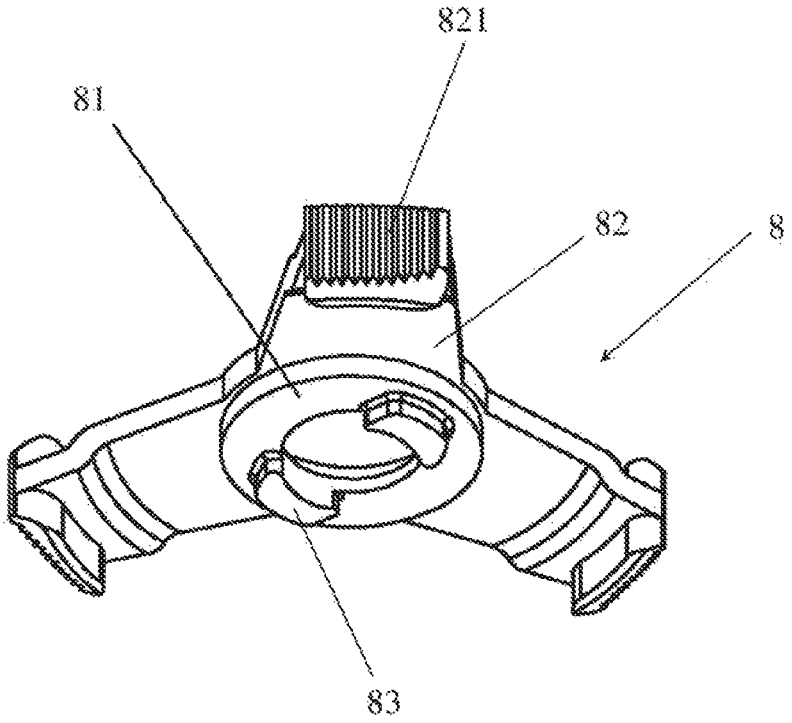
FIG. 23 is a perspective view of an unlocking handle of the lock.
Figure 24:
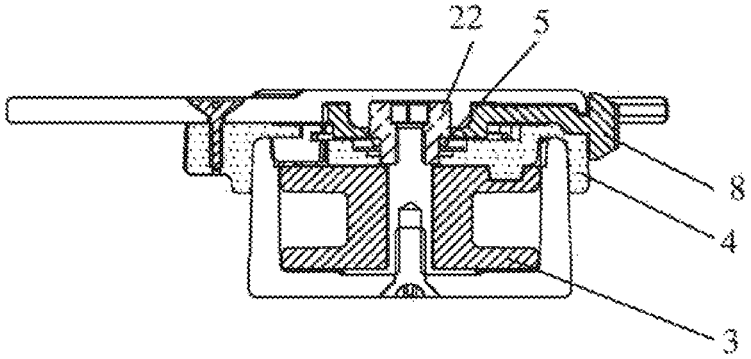
FIG. 24 is a sectional view illustrating the lock in a locking state.

Now the lock according to the third embodiment of the disclosure will be explained with reference to FIGS. 21 to 25. FIG. 21 is an exploded and perspective view of a lock according to the third embodiment of the disclosure; FIGS. 22A and 22B are the perspective views of the retracting tooth cover 4 in the lock from two angles; FIG. 23 is a perspective view of an unlocking handle 8 of the lock; FIG. 24 is a sectional view illustrating the lock in a locking state; and FIG. 25 is a sectional view illustrating the lock in an unlocking state.

Figure 25:
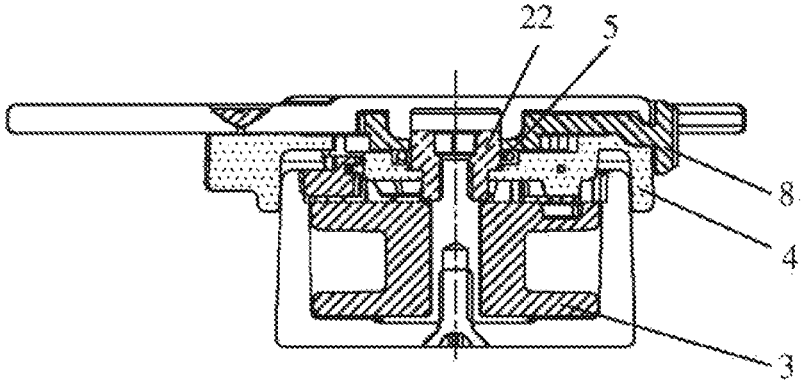
FIG. 25 is a sectional view illustrating the lock in an unlocking state.

As shown in FIG. 21, the lock includes: a base 1 which is for example secured to one side of the upper by riveting and which is generally in a form of a tube with one end closed, and one end opened as seen in FIGS. 24 and 25, wherein the inner peripheral face at the edge of the opening end is provided with ratchets 11; a main shaft 21 which is for example secured onto the bottom wall of the base by a set screw 20 and is perpendicular to the bottom wall of the base; a reel 3 rotatably provided on the main shaft 21 and received in the base 1; a retracting tooth cover 4 which is covered on the retracting reel 3 and is provided around the main shaft 21 rotatably and axially movably; an unlocking handle 8 which is rotatably provided around the main shaft 21; a locking cap 22 which is connected to an end of the main shaft 21 opposite to the end engaged with the set screw 20 and prevents the reel 3, the retracting tooth cover 4 and the unlocking handle 8 arranged on the main shaft 21 from detaching therefrom; and a handle 30 which is connected with the retracting tooth cover 4 by screws 91.

As shown in FIG. 21, the reel 3 is spool-shaped, and includes a winding slot 31 formed on the outer peripheral face and teeth 32 formed on the outer face of the reel 3 (the side facing away from the ski boots).

As shown in FIGS. 22A and 22B, the retracting tooth cover 4 is substantially shaped like a bottle cap and snap-fit on the opening of the base 1. A boss 44 is protruded from a surface of an inner side (that is, the side facing the ski boots) of the cover 4. Teeth 42 are formed on a surface of the boss 44. When the lock is in the locking position, the teeth 42 may engage with the teeth 32 of the reel 3 and thus drive the reel 3 in rotation. Additionally, recesses 45 are formed at a plurality of positions on the outer periphery of the boss 44 (three positions as shown). Ratchets 6 are respectively arranged in the recesses 45 and biased outward by the spring 7 so that the ratchets 6 respectively engage with the ratchets 11 of the base 1 and forms a unidirectional ratchet structure when the retracting tooth cover 4 is snap-fit on the opening of the base 1. In particular, the ratchets 11 of the base are oriented so that the ratchets 11 press against the ratchets 6 as the retracting tooth cover 4 rotates in a first direction (e.g., the clockwise direction) relative to the base 1. Therefore the ratchets 6 overcome the biasing force of the spring 7 and retract back to the recesses 45 so that the retracting tooth cover 4 is able to rotate relative to the base 1; when the retracting tooth cover 4 rotates relative to the base in a second direction opposite to the first direction (e.g., the anticlockwise direction), ratchets 11 and ratchets 6 latch so as to prevent the retracting tooth cover 4 from rotating relative to the base 1.

As shown in FIG. 22A, a boss 41 is arranged on the outer surface of the retracting tooth cover 4 (the side facing away the ski boots), around which a locking circlip 5 is provided.

As shown in FIG. 21, the locking circlip 5 is a ring in a substantially oval shape. And the diameter in the direction of its short axis direction is much shorter than that in the direction of its long axis.

Three lugs 43 are also provided on the outer periphery of the retracting tooth cover 4. Each lug 43 has a threaded hole formed therein for the engagement of the set screws 91. The handle 30 is connected with the retracting tooth cover 4 together by the set screws 91 so that the handle 30 may rotate together with the retracting tooth cover 4.

Outside the retracting tooth cover 4, an unlocking handle 8 is arranged around the main shaft 21 as shown in FIG. 23. The unlocking handle 8 includes a central circular plate 81 and three branches 82 which radially extend outside from the central circular plate 81 with a uniform spacing for easy gripping. Two unlocking blocks 83 are oppositely arranged on an inner surface of the central circular plate 81 of the unlocking handle 8 and inserted inside the locking circlip 5 which is a substantially oval-shaped ring.

The locking cap 22 is connected onto the outside end of the main shaft 21 so as to prevent the reel 3, the retracting tooth cover 4 and the unlocking handle 8 from detaching from the main shaft 21. The locking cap 22 includes a small diameter portion 221 and a large diameter portion 222. The small diameter portion 221 is inserted inside the long oval ring of the locking circlip 5. And in the original state, the diameter of the locking circlip 5 in the short axis direction is smaller than that of the large diameter portion 222, therefore resting against the end face of the large diameter portion 222.

Now the lock according to the third embodiment of the disclosure will be explained with reference to FIGS. 24 to 25.

As shown in FIG. 24, it illustrates the lock in the locking state. In the locking state, the retracting tooth cover 4 is covered on the opening of the base 1 and the teeth 42 on the retracting tooth cover 4 mesh with the teeth 32 of the reel 3. Meanwhile, unidirectional ratchets 6 arranged on the retracting tooth cover 4 engage the ratchets 11 of the base 1. At this moment, since the locking circlip 5 is in the original state, the diameter of the locking circlip 5 in the short axis direction is smaller than that of the locking circlip 5 in the long axis direction, it is prevented by the large diameter portion 222 of the locking cap 222 from moving outside. Therefore, the engagement between the retracting tooth cover 4 and the reel 3 and the base 1 is held. In this status, by turning the handle along the retracting direction (e.g., the clockwise direction), the retracting tooth cover 4 is allowed to rotate relative to the base 1 and drives the reel 3 in rotation along the retracting direction so as to wind in the line and lock the ski boot; in addition, since the unidirectional ratchets 6 arranged on the retracting tooth cover 4 form the unidirectional rotating structure with the ratchets 11 on the base 1, the reel 3 and the retracting tooth cover 4 are prevented from rotating in opposite direction so that the line cannot be released and the ski boot is prevented from being released.

When the skier for example wants to take off the ski boots, he should place the lock in the unlocking state so as to release the line. In this situation, the skier rotates the unlocking handle 8 and the unlocking block 83 of the unlocking handle 8 rotates inside the locking circlip 5 so as to expand the locking circlip 5. Then the opening of the locking circlip 5 along the short axis direction is larger than the diameter of the large diameter portion 222 and the axial movement of the retracting tooth cover 4 is not prevented any longer. Therefore, the retracting tooth cover 4 may move outward so as to release the teeth 42 of the retracting tooth cover 4 and the teeth 32 of the reel 3, resulting in the free rotation of the reel 3. By means of the force of the opening springs 1224, 1234 of the upper right portion 122 and the upper left portion 123, the upper right portion 122 and the upper left portion 123 rotate to the opening state and the skier can easily take off the liner 200.

In addition, a controller is also arranged on the ski boot which includes a sensor or is connected in communication with a sensor. The sensor is arranged on the inside of the ski boot and is located so as to be in contact with the skier's foot artery when the skier puts on the boot. Therefore, signals of the skier's vital signs, such as the heart rate, blood pressure, temperature and the like, are obtained and sent to the controller.

The controller determines the status of the skier according to the signals obtained by the sensor. For example, the controller may compare the signals obtained by the sensor with the preset allowable ranges so as to determine whether one or more items of the heart rate, blood pressure and temperature are within the allowable ranges. When it is determined that one or more items of the heart rate, blood pressure and temperature are beyond the allowable ranges, the controller sends an alerting signal. Said alerting signal includes for example signals such as sounds, lights and the like. Alternatively or additionally, When it is determined that one or more items of the heart rate, blood pressure and temperature are beyond the allowable ranges, the controller may send an alerting signal to a designated destination for example by a built-in communication module or a communication module connected therewith. Said sending may be carried out for example by wireless network such as Wifi, NFC, Bluetooth, 4G, 5G or the like.

Additionally, the ski boots may be provided with a tilt sensor so as to determine the orientation of the ski boots and thus the posture of the skier. And when the tilt angle of the ski boots exceeds a threshold for a predetermined period, the controller will trigger the sensor to detect the signals representing the vital signs of the skier.

In addition, the controller may determine the status of the skier according to the signals representing the vital signs of the skier obtained from the sensor, and categorize the status of the skier into four categories, which for example are: the first category which refers to critical stage, in which the skier is subject to life threat and needs immediate treat and rescue, and the controller controls the communication module to send an emergency rescue signal to a designated destination such as rescue stations and/or an emergency contact of the skier; the second category which refers to emergency stage, in which the skier still needs rescue or other's help but not as urgent as in the critical stage; the third category which refers to dangerous stage, in which the skier is at the edge of danger but may self-restore, and thus the controller may not send a rescue signal at first but check back the skier's status after a certain period time; when both the two statuses indicate that the vital signs of the skier are endangered, the controller will send a rescue signal to a designated destination; and the fourth category which refers to self-restoration stage, in which the controller may not send a rescue signal but wait for the skier's self-restoration, and meanwhile the controller may keep detecting the vital signs of the skier, additionally or alternatively the controller may trigger the rescue devices for example arranged on the snowsuit (such as a heating device) so as to expedite the skier's self-restoration.

The description of the preferred embodiments of the disclosure has been provided in the above. It shall be noted that the disclosure is not limited to the details of the above preferred embodiment, and the skilled in the art may make various changes and modifications based on the teachings of the disclosure. For example, in the above embodiments, the ratchets of the locking sleeve and the ratchets of the reel are in opposite directions so as to perform the function that the reel is able to be driven in only one direction and is locked in the other direction. However in fact, the directions of both the ratchets can be same, and the claws engaging with the two ratchets can be made in reverse configurations so as to perform the same function of unidirectional driving.

Although the above describes the preferred embodiment of the disclosure in detail, those skilled in the art may conceive various improvements and modifications in light of the above description. Therefore, the disclosure should not be limited to the above embodiments. The protection scope of the disclosure is merely defined by the attached claims and equivalents thereof.

What is claimed is:

1. A pair of ski boots, each of which includes a shell and a liner, wherein the shell includes a sole that is unitary and an upper including an upper lateral portion and an upper medial portion, wherein the upper lateral portion and the upper medial portion are hingedly connected onto the sole so as to rotate relative to the sole between an opened state and a closed state, wherein the shell also includes a lock and a locking line, and wherein the locking line winds around the upper at a plurality of positions, and is able to be retracted into the lock so as to maintain the upper lateral portion and the upper medial portion in the closed state and is able to be released from the lock so as to rotate the upper lateral portion and the upper medial portion into the opened state.

2. The ski boots according to claim 1, wherein the upper also includes a toe cap portion and a heel portion, wherein in the closed state, the upper lateral portion and the upper medial portion are at least partially overlapped with the heel portion, wherein the heel portion is provided with a plurality of positioning slots or ribs, wherein the upper lateral portion and the upper medial portion are provided with protrusions or slots at the corresponding positions, and wherein the positioning slots or ribs engage with the protrusions or slots respectively when the upper lateral portion and the upper medial portion are in the closed state.

3. The ski boots according to claim 2, wherein in the closed state, the upper lateral portion and the upper medial portion are at least partially overlapped with the toe cap portion, wherein the toe cap portion is provided with a plurality of positioning recesses or protrusions in portions overlapping with the upper lateral portion and the upper medial portion, wherein the upper lateral portion and the upper medial portion are provided with a plurality of protrusions or recesses at the corresponding positions; and wherein the positioning protrusions engage into the positioning recesses respectively when the upper lateral portion and the upper medial portion are in the closed state.

4. The ski boots according to claim 3, wherein the upper comprises a tongue portion, wherein a biasing device is provided at a position where the tongue portion and the toe cap portion are articulated so as to bias the tongue portion toward the outside.

5. The ski boots according to claim 1, wherein biasing devices are provided at positions where the upper lateral portion and the upper medial portion are respectively hingedly connected with the sole, which respectively bias the upper lateral portion and the upper medial portion toward the opened state.

6. The ski boots according to claim 1, wherein one or more bosses are provided at bottoms of the upper lateral portion and the upper medial portion, and wherein the bosses press against the sole of the liner when the liner is inserted into the shell and the shell is closed.

7. The ski boots according to claim 1, wherein one or more slots are respectively formed on both sides of the sole of the liner and one or more tabs are formed at corresponding positions on the bottom of the inside of the upper lateral portion and the upper medial portion, and wherein the tabs are pressed into the slots when the upper of the shell is in the closed position.

8. The ski boots according to claim 1, wherein the ski boot is also provided with a controller and a sensor, wherein the sensor is configured to sense one or more signals indicating one or more vital signs of the skier wearing the ski boots, and wherein the controller is configured to receive the signals sensed by the sensor and determine a vital status of a wearer of the ski boots based on the signals.

9. The ski boots according to claim 8, wherein the controller is also configured to determine the vital status of the wearer as one of a plurality of categories based on the signals sensed by the sensor.

10. The ski boots according to claim 9, wherein the vital signs include one or more of the heart rate, the blood pressure or temperature of the wearer.

11. The ski boots according to claim 8, wherein the controller is also configured to send a rescue signal to a designated location when it is determined that the vital status of the wearer is in danger.

12. The ski boots according to claim 11, wherein the designated destination includes a plurality of designated destinations.

13. The ski boots according to claim 11, wherein the rescue signal includes a signal indicating the vital signs of the wearer.

14. The ski boots according to claim 9, wherein the controller is also configured not to send a rescue signal to a designated destination or actuate a rescue device when it is determined that the vital status of the wearer is that the wearer is able to be self restored.

15. The ski boots according to claim 1, wherein the lock includes:

a base secured on the upper lateral portion or the upper medial portion;

a main shaft secured on the base;

a reel, a retracting tooth cover and an unlocking handle that are arranged in succession rotatably on the main shaft;

a locking cap connected on the main shaft, which is intended to prevent the reel, the retracting tooth cover and the unlocking handle from detaching therefrom; and a handle that is connected with the retracting tooth cover, wherein by means of the rotation of the unlocking handle, the retracting tooth cover is allowed to move between a locking position and an unlocking position, wherein in the locking position, the retracting tooth cover engages the reel so as to allow the reel to rotate with the retracting tooth cover, and wherein in the unlocking position, the retracting tooth cover disengages from the reel so as to allow the free rotation of the reel around the main shaft.

16. The ski boots according to claim 15, wherein the movement of the retracting tooth cover between the locking position and the unlocking position is an axial movement of the retracting tooth cover along the main shaft.

17. The ski boots according to claim 16, wherein the base is barrel-shaped and is provided with one or more ratchets on an inner circumferential face which is open at one end, wherein the retracting tooth cover is provided with bosses extending into an opening of the base, wherein unidirectional ratchets are provided on an outer periphery of each of the bosses and are biased outward so as to engage with the one or more ratchets, and wherein the one or more ratchets of the base are oriented so that the retracting tooth cover is able to rotate relative to the base in a first direction and is prevented from rotating relative to the base in a second direction opposite to the first direction.

18. The ski boots according to claim 17, wherein one or more teeth are provided on a surface on one side of the bosses, wherein the surface of the reel facing the retracting tooth cover are provided with one or more teeth, and wherein the respective one or more teeth mesh each other in the locking position, and the retracting tooth cover is moved away from the reel along the axial direction so that the respective one or more teeth are disengaged in the unlock position.

19. The ski boots according to claim 18, wherein a locking circlip is arranged between the retracting tooth cover and a locking cap which includes a large diameter portion corresponding to the unlock position and a small diameter portion corresponding to the locking position, and wherein the locking circlip is long oval shaped and has a diameter on a short axis that is smaller than a diameter of the large diameter portion in an original status.

20. The ski boots according to claim 19, wherein the unlocking handle includes an unlocking boss that extends into the locking circlip, and wherein the unlocking boss pushes the locking circlip open so as to be larger than the large diameter portion when the unlocking handle is rotated, to allow the retracting tooth cover to be moved from the small diameter portion to the large diameter portion.

* * * * *